US010738404B2

(12) United States Patent
Kim et al.

(10) Patent No.: US 10,738,404 B2
(45) Date of Patent: Aug. 11, 2020

(54) WASHING MACHINE AND METHOD FOR CONTROLLING THE SAME

(71) Applicant: LG ELECTRONICS INC., Seoul (KR)

(72) Inventors: Naeun Kim, Seoul (KR); Hwanjin Jung, Seoul (KR); Sanghyun Lee, Seoul (KR); Bonkwon Koo, Seoul (KR); Sunho Lee, Seoul (KR); Dongwon Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 416 days.

(21) Appl. No.: 15/283,601

(22) Filed: Oct. 3, 2016

(65) Prior Publication Data

US 2017/0096768 A1 Apr. 6, 2017

(30) Foreign Application Priority Data

Oct. 2, 2015 (KR) ..... 10-2015-0139272
Oct. 2, 2015 (KR) ..... 10-2015-0139275
(Continued)

(51) Int. Cl.
*D06F 39/00* (2020.01)
*D06F 33/02* (2006.01)
(Continued)

(52) U.S. Cl.
CPC ..... *D06F 34/18* (2020.02); *D06F 33/00* (2013.01); *D06F 35/006* (2013.01); *D06F 37/12* (2013.01);
(Continued)

(58) Field of Classification Search
CPC ..... D06F 33/02; D06F 35/006; D06F 37/12; D06F 39/003; D06F 39/088;
(Continued)

(56) References Cited

U.S. PATENT DOCUMENTS 2,993,357 A 7/1961 Smith et al.
3,324,688 A 6/1967 Hubbard
(Continued)

FOREIGN PATENT DOCUMENTS

CN 1285430 2/2001
CN 1534131 10/2004
(Continued)

OTHER PUBLICATIONS

Australian Office Action dated Aug. 2, 2017 issued in Application No. 2016234988.
(Continued)

*Primary Examiner* — Benjamin L Osterhout
(74) *Attorney, Agent, or Firm* — KED & Associates LLP

(57) ABSTRACT

A washing machine and a method for controlling a washing machine are provided. The method may include sensing an amount of laundry in an inner tub, configuring an operation setting based on the amount of the laundry sensed, supplying water into the inner tub and obtaining a preliminary water supply time taken for a water level within an outer tub to reach a predetermined preliminary water supply level, spraying the water from the outer tub into the inner tub through a circulation nozzle by driving a pump and obtaining a change of water level within the outer tub as the water is sprayed through the circulation nozzle, adjusting the operation setting based on the preliminary water supply time obtained and the change of water level obtained, and performing a washing operation based on the adjusted operation setting.

11 Claims, 38 Drawing Sheets

(30) Foreign Application Priority Data

Oct. 2, 2015 (KR) ..... 10-2015-0139279
Oct. 8, 2015 (KR) ..... 10-2015-0141714

(51) Int. Cl.

| | |
|---|---|
| ***D06F 35/00*** | (2006.01) |
| ***D06F 37/12*** | (2006.01) |
| ***D06F 39/08*** | (2006.01) |
| ***D06F 34/18*** | (2020.01) |
| ***D06F 33/00*** | (2020.01) |
| *D06F 23/04* | (2006.01) |

(52) U.S. Cl.
CPC ..... *D06F 39/088* (2013.01); *D06F 23/04* (2013.01); *D06F 39/083* (2013.01); *D06F 39/085* (2013.01); *D06F 2202/10* (2013.01); *D06F 2204/06* (2013.01); *D06F 2204/082* (2013.01); *D06F 2204/086* (2013.01); *D06F 2204/10* (2013.01)

(58) Field of Classification Search
CPC .. D06F 39/085; D06F 39/083; D06F 2204/10; D06F 23/04; D06F 2202/10; D06F 2204/06; D06F 2204/082; D06F 2204/086
See application file for complete search history.

(56) References Cited

U.S. PATENT DOCUMENTS

| | | | | |
|---|---|---|---|---|
| 5,031,427 | A | 7/1991 | Pastryk et al. | |
| 5,167,722 | A | 12/1992 | Pastryk et al. | |
| 5,271,251 | A | 12/1993 | Kovich et al. | |
| 5,582,039 | A | 12/1996 | Mueller et al. | |
| 6,125,490 | A | 10/2000 | Riechman et al. | |
| 6,269,666 | B1 | 8/2001 | Whah et al. | |
| 6,842,929 | B2 | 1/2005 | Kim et al. | |
| 6,871,370 | B2 | 3/2005 | Choi et al. | |
| 8,733,136 | B2 | 5/2014 | Chung et al. | |
| 9,080,273 | B2 | 7/2015 | Moschütz et al. | |
| 2003/0051514 | A1 | 3/2003 | Kim et al. | |
| 2004/0163427 | A1 | 8/2004 | Oh et al. | |
| 2005/0125909 | A1 | 6/2005 | Bellinetto et al. | |
| 2006/0191078 | A1* | 8/2006 | Kim | D06F 33/02 8/159 |
| 2007/0067920 | A1 | 3/2007 | Zaccone | |
| 2008/0229517 | A1* | 9/2008 | Amarillas | D06F 35/005 8/159 |
| 2009/0229312 | A1 | 9/2009 | Chung et al. | |
| 2009/0241270 | A1* | 10/2009 | La Belle | D06F 33/00 8/159 |
| 2010/0236001 | A1 | 9/2010 | Lee et al. | |
| 2010/0251784 | A1 | 10/2010 | Lee | |
| 2010/0281927 | A1 | 11/2010 | Lee et al. | |
| 2011/0000558 | A1 | 1/2011 | Harwood et al. | |
| 2011/0061172 | A1* | 3/2011 | Koo | D06F 35/007 8/137 |
| 2011/0247148 | A1 | 10/2011 | Chanda et al. | |
| 2011/0265525 | A1 | 11/2011 | Gweon | |
| 2012/0114473 | A1 | 5/2012 | Badafem et al. | |
| 2012/0167931 | A1 | 7/2012 | Park et al. | |
| 2013/0042416 | A1* | 2/2013 | Balinski | D06F 39/002 8/137 |
| 2013/0091635 | A1 | 4/2013 | Guzman | |
| 2013/0091726 | A1* | 4/2013 | Kim | D06F 58/22 34/427 |
| 2013/0312202 | A1* | 11/2013 | Balinski | D06F 33/02 8/137 |
| 2014/0033449 | A1* | 2/2014 | Im | D06F 39/08 8/137 |
| 2014/0096327 | A1 | 4/2014 | Lee et al. | |
| 2014/0259448 | A1 | 9/2014 | Alexander et al. | |
| 2015/0121629 | A1 | 5/2015 | Jang | |
| 2015/0211171 | A1 | 7/2015 | Favaro et al. | |
| 2015/0240405 | A1 | 8/2015 | Kwon et al. | |

FOREIGN PATENT DOCUMENTS

| | | |
|---|---|---|
| CN | 1219928 | 9/2005 |
| CN | 101058932 | 10/2007 |
| CN | 101351588 | 1/2009 |
| CN | 102234897 | 11/2011 |
| CN | 102587091 | 7/2012 |
| CN | 102597354 | 7/2012 |
| CN | 101858023 | 5/2013 |
| CN | 103119212 | 5/2013 |
| CN | 103348052 | 10/2013 |
| CN | 103906871 | 7/2014 |
| CN | 204138949 | 2/2015 |
| EP | 0 464 776 | 1/1992 |
| EP | 2 698 464 | 2/2014 |
| EP | 2 698 467 | 2/2014 |
| EP | 2 719 812 | 4/2014 |
| EP | 2 806 062 | 11/2014 |
| EP | 2 845 941 | 3/2015 |
| GB | 1 200 197 | 7/1970 |
| JP | S 56-098176 | 8/1981 |
| JP | S 62-066895 | 3/1987 |
| JP | H 05-068488 | 9/1993 |
| JP | H 08-173683 | 7/1996 |
| JP | H 09-192383 | 7/1997 |
| JP | H 11-019391 | 1/1999 |
| JP | H 11-276791 | 10/1999 |
| JP | 2000-189693 | 7/2000 |
| JP | 2001-070694 | 3/2001 |
| JP | 2001-300179 | 10/2001 |
| JP | 3434785 | 8/2003 |
| JP | 2004-065638 | 3/2004 |
| JP | 2004-116425 | 4/2004 |
| JP | 2007-029205 | 2/2007 |
| JP | 2007-282934 | 11/2007 |
| JP | 2008-012140 | 1/2008 |
| JP | 2008-073128 | 4/2008 |
| JP | 2009-268848 | 11/2009 |
| JP | 2009-297139 | 12/2009 |
| JP | 2010-046121 | 3/2010 |
| JP | 2010-046125 | 3/2010 |
| JP | 2012-157417 | 8/2012 |
| JP | 2013-188287 | 9/2013 |
| JP | 2014-054277 | 3/2014 |
| JP | 2014-510605 | 5/2014 |
| JP | 2014-100428 | 6/2014 |
| KR | 10-2000-0027871 | 5/2000 |
| KR | 10-2001-0018294 | 3/2001 |
| KR | 10-2001-0018300 | 3/2001 |
| KR | 10-2005-0012524 | 2/2005 |
| KR | 10-2009-0100155 | 9/2009 |
| KR | 10-2009-0122804 | 12/2009 |
| KR | 10-2010-0105339 | 9/2010 |
| KR | 10-2010-0110676 | 10/2010 |
| KR | 10-2010-0110717 | 10/2010 |
| KR | 10-2011-0009918 | 1/2011 |
| KR | 10-2011-0009926 | 1/2011 |
| KR | 10-2011-0086421 | 7/2011 |
| KR | 10-2012-0011940 | 2/2012 |
| KR | 10-2012-0012216 | 2/2012 |
| KR | 10-2012-0040793 | 4/2012 |
| KR | 10-2013-0034311 | 4/2013 |
| KR | 10-2013-0109354 | 10/2013 |
| KR | 10-2014-0030187 | 3/2014 |
| KR | 10-2015-0099114 | 8/2015 |
| RU | 2 495 174 | 10/2013 |
| WO | WO 2009/102106 | 8/2009 |
| WO | WO 2013/035279 | 3/2013 |

OTHER PUBLICATIONS

Derwent Abstract of WO 2013035279 A1 (cited above) (Year: 2013).
Russian Notice of Allowance dated Nov. 23, 2017 issued in Application No. 2016138672/12(061605).
Australian Office Action dated Dec. 5, 2017 issued in Application No. 2016234990.

(56) References Cited

OTHER PUBLICATIONS

U.S. Office Action dated Feb. 12, 2018 issued in co-pending U.S. Appl. No. 15/283,763.
Japanese Office Action dated Dec. 19, 2017 issued in Application No. 2016-195750.
Japanese Office Action dated Jan. 9, 2018 issued in Application No. 2016-195649.
Japanese Office Action dated Jan. 9, 2018 issued in Application No. 2016-195781.
United States Office Action dated Jan. 10, 2019 issued in co-pending related U.S. Appl. No. 15/283,527.
United States Office Action dated Jan. 10, 2019 issued in co-pending related U.S. Appl. No. 15/283,571.
Chinese Office Action dated Sep. 4, 2018 issued in Application No. 201610881043.4 (English translation attached).
Chinese Office Action dated Sep. 20, 2018 issued in Application No. 201610877950.1 (with English Translation).
Korean Notice of Allowance dated Dec. 5, 2016 issued in Application No. 10-2015-0139275.
United States Office Action dated Apr. 13, 2018 issued in co-pending related U.S. Appl. No. 15/283,488.
United States Office Action dated May 3, 2018 issued in co-pending related U.S. Appl. No. 15/283,662.
Russian Search Report dated Sep. 6, 2017 issued in Application No. 2016138670/12(061603).
Korean Office Action dated Sep. 26, 2017 issued in Application No. 10-2015-0139279.
Russian Office Action (with full English translation) dated Oct. 17, 2017 issued in Application No. 2016138669/12(061602).
Australian Office Action dated Nov. 10, 2017 issued in Application No. 2016234984.
Korean Office Action dated Jul. 1, 2016 issued in Application No. 10-2015-0139276.
Korean Office Action dated Aug. 2, 2016 issued in Application No. 10-2015-0139277.
Chinese Office Action dated Oct. 12, 2018 issued in Application No. 201610880710.7 (with English Translation).
Korean Office Action dated Jul. 13, 2016 issued in Application No. 10-2015-0141714.
Korean Office Action dated Aug. 18, 2016 issued in Application No. 10-2015-0139272.
Korean Office Action dated Feb. 28, 2017 issued in Application No. 10-2015-0139279.
Indian Office Action dated Mar. 11, 2019 issued in Application No. 201634033588.
U.S. Final Office Action dated Oct. 7, 2019 issued in related U.S. Appl. No. 15/283,488.
U.S. Appl. No. 15/283,488, filed Oct. 3, 2016, Spencer E. Bell.
U.S. Appl. No. 15/283,527, filed Oct. 3, 2016, Benjamin Lee Osterhout.
U.S. Appl. No. 15/283,571, filed Oct. 3, 2016, Benjamin Lee Osterhout.
U.S. Appl. No. 15/283,662, filed Oct. 3, 2016, Cristi J. Tate-Sims.
U.S. Appl. No. 15/283,488, filed Oct. 3, 2016, Michael E. Barr.
U.S. Appl. No. 15/283,527, filed Oct. 3, 2016, Michael E. Barr.
U.S. Appl. No. 15/283,571, filed Oct. 3, 2016, Michael E. Barr.
U.S. Appl. No. 15/283,662, filed Oct. 3, 2016, Michael E. Barr.
U.S. Appl. No. 15/283,763, filed Oct. 3, 2016, Michael E. Barr.
U.S. Appl. No. 15/283,763, filed Oct. 3, 2016, Cristi J. Tate-Sims.
U.S. Appl. No. 15/283,488, filed Oct. 3, 2016.
U.S. Appl. No. 15/283,527, filed Oct. 3, 2016.
U.S. Appl. No. 15/283,571, filed Oct. 3, 2016.
U.S. Appl. No. 15/283,662, filed Oct. 3, 2016.

* cited by examiner

WASHING MACHINE AND METHOD FOR CONTROLLING THE SAME

CROSS-REFERENCE TO RELATED APPLICATIONS

This application claims priority under 35 U.S.C. § 119 to Korean Application Nos. 10-2015-0139279 filed on Oct. 2, 2015, 10-2015-0139272 filed on Oct. 2, 2015, 10-2015-0139275 filed on Oct. 2, 2015, and 10-2015-0141714 filed on Oct. 8, 2015, whose entire disclosures are incorporated herein by reference.

BACKGROUND OF THE INVENTION

1. Field

Embodiments relate to a washing machine and a method for controlling a washing machine.

2. Background

A washing machine is an apparatus for processing laundry through several actions, such as, e.g. washing, dehydrating and/or drying. The washing machine includes an outer tub configured to store water and an inner tub rotatably provided in the outer tub. A plurality of through holes through which water passes is formed in the inner tub. When a user selects a required course using a control panel in a state in which laundry or clothes has been thrown into the inner tub, the washing machine executes a predetermined algorithm in response to the selected course, so that fast water discharge, washing, rinsing, and dehydrating may be performed.

A washing operation may be divided into a washing cycle, a rinsing cycle, and a dehydration cycle. A progress of such cycles may be checked through a display included in a control panel. The washing cycle may be performed to clean laundry or clothes using a detergent and rotation of a pulsator and/or the inner tub by supplying the detergent to the inner tub along with water. The rinsing cycle may be performed to rinse laundry or clothes by supplying clean water in which a detergent has not dissolved to the inner tub. For example, a detergent absorbed by clothes when the washing cycle is performed may be removed. In the rinsing cycle, a fabric softener may be supplied along with water. The dehydration cycle may be performed to dehydrate or remove water from laundry or clothes by rotating the inner tub at a high speed after the rinsing cycle is completed. When the dehydration cycle is completed, entire operation of the washing machine may be terminated. In the case of a combined drying and washing machine, however, a drying cycle may be further added after the dehydration cycle.

A type of washing machine may be divided into a top loading washing machine, in which laundry or clothes are thrown in from a top and the inner tub is rotated around a vertical axis, and a front loading washing machine, in which laundry or clothes are thrown in from a front and the inner tub is rotated around a horizontal axis. The washing operation of the top loading washing machine may be configured based on an amount of laundry, or a laundry amount, thrown into the inner tub. For example, a water supply level, a washing intensity, a water discharge time, and a dehydration time may be set based on a laundry amount.

However, washing performance may have a deviation depending on a quality of laundry, or a laundry quality, in addition to a laundry amount. There may be a problem in that sufficient washing performance may not be expected if only the laundry amount is taken into consideration in configuring a washing operation. For example, in a case of a water-repellent material having a low moisture content ratio, or a ratio at which laundry or the material contains water, washing may be sufficiently performed using a small amount of water even if there is a large amount of laundry. In contrast, in a case of laundry having a high moisture content ratio, for example, winter clothes or bedclothes, more water may be required even if there is a small amount of laundry. Accordingly, it may be necessary to determine laundry quality based on a moisture content ratio and to set a configuration of a washing operation using a proper method based on laundry quality.

Furthermore, if a fabric membrane, for example, a membrane structure formed by laundry, is formed in the inner tub, a washing operation suitable for the fabric membrane needs to be performed. However, related art washing machines may have a problem in that a washing operation suitable for laundry capable of forming a fabric membrane is not performed because a time when the laundry are thrown in cannot be detected in advance.

BRIEF DESCRIPTION OF THE DRAWINGS

The embodiments will be described in detail with reference to the following drawings in which like reference numerals refer to like elements wherein.

DETAILED DESCRIPTION

Figure 1:
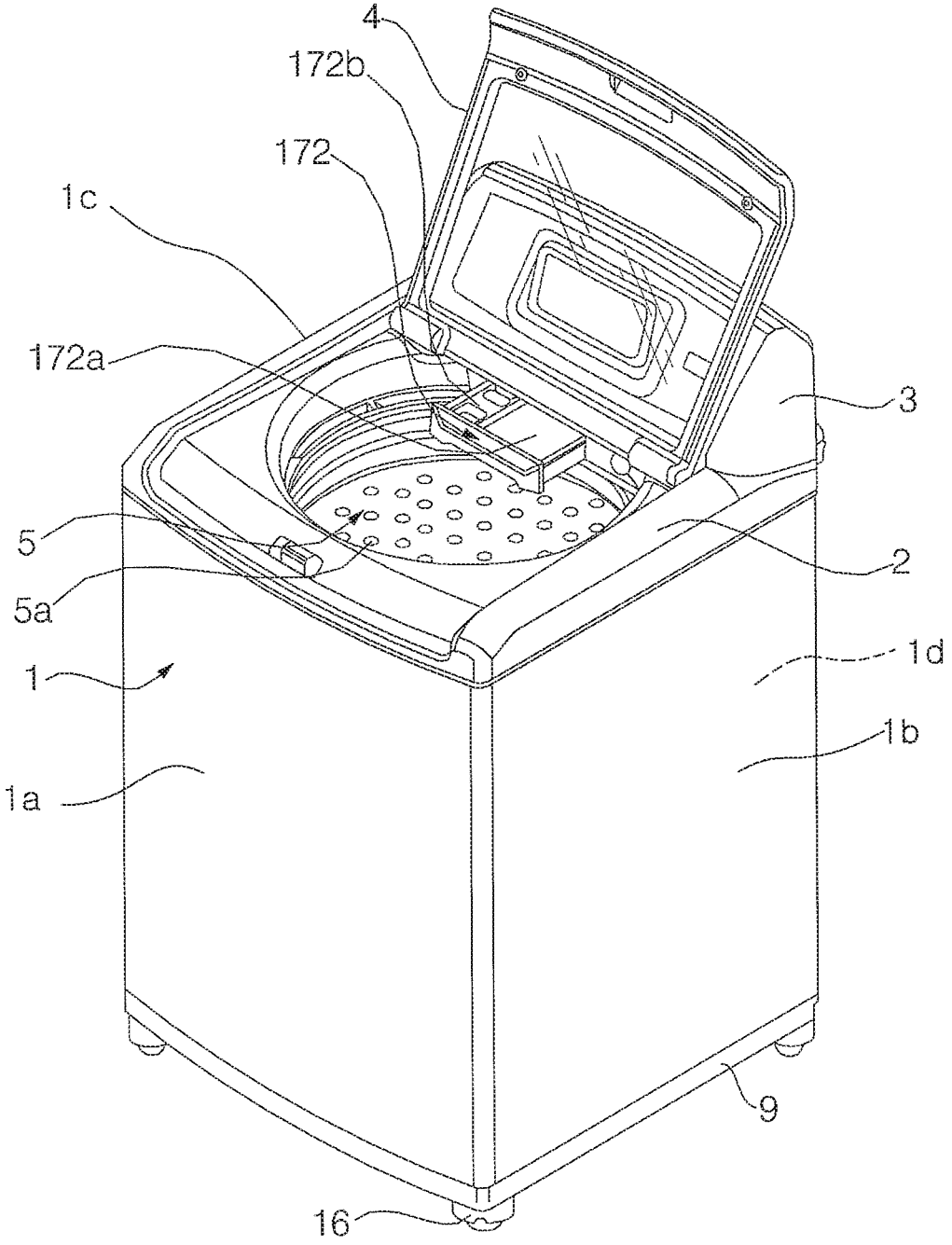
FIG. 1 is a perspective view of a washing machine according to an embodiment.
Figure 2:
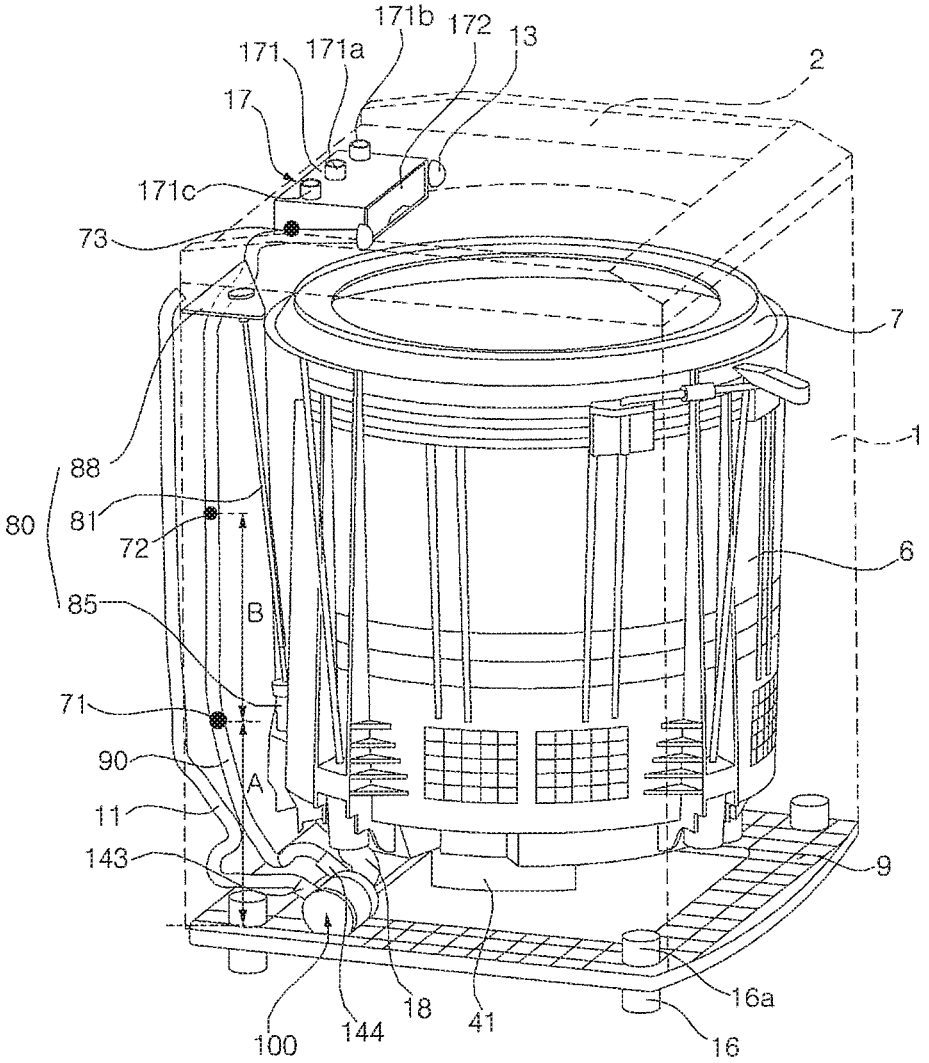
FIG. 2 is a side cross-sectional view of the washing machine shown in FIG. 1.

Referring to FIGS. 1 to 4, the washing machine according to an embodiment of the present disclosure may include a base 9, a cabinet 1, a top cover 2, a lid 4, and a control panel 3. The base 9 may have a flat form corresponding to the bottom on which the washing machine is installed. The base 9 may be supported by four support legs 16 installed near the four corners of the cabinet 1. A pump 100 may be installed on the base 9.

The base 9 forms an external appearance of an approximately rectangular form. The support legs 16 are provided at respective points inward spaced apart from the four vertexes of a rectangular form. The support legs 16 are protruded downward from the base 9 and come into contact with the bottom such as an indoor floor on which the washing machine stands. The four support legs 16 support the base 9, and the base 9 supports the entire washing machine.

The cabinet 1 is supported by the base 9, and is configured to include a front part 1*a*, both side units 1*b* and 1*c*, and a backside unit 1*d* installed on the outside corners of the base 9 so that the space in which the outer tub 6 is accommodated is formed within the cabinet 1. The top and bottom of the cabinet 1 may be opened. The top cover 2 may be coupled to the top of the cabinet 1. A feeding entrance for the throwing and drawing of laundry or clothes may be formed in the top cover 2. The lid 4 for opening and shutting the feeding entrance may be rotatably coupled to the top cover 2.

The outer tub 6 for receiving water may be provided in the cabinet 1. The outer tub 6 may be provided in a form hung within the cabinet 1 by a hanger 80. The hanger 80 may include a support rod 81 configured to have a top pivotally coupled to the top cover 2 and a suspension installed on the support rod 81 and configured to absorb the vibration of the outer tub 6. The suspension may have various forms. For example, the suspension may include an outer tub support member configured to support the outer tub 5 and to move along the support rod 81 when the outer tub 6 is vibrated and a spring fixed to the lower part of the support rod 81 and configured to elastically support the outer tub support member.

Figure 3:
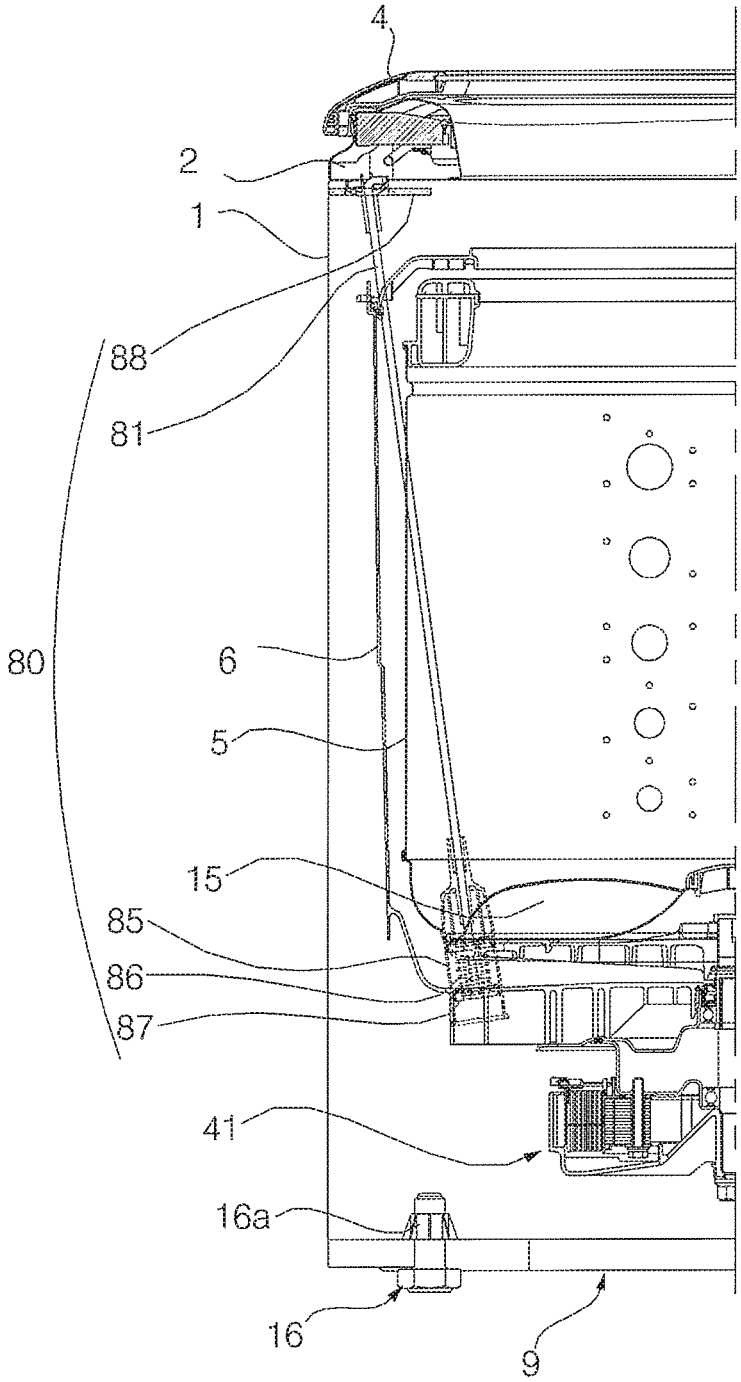
FIG. 3 shows part of the washing machine of FIG. 1 and is a cross-sectional view showing a structure of a hanger.

Referring to FIG. 3, a hanger bracket 88 may be provided above the outer tub 6 within the cabinet 1. The hanger bracket 88 may be provided in the top cover 2. The support rod 81 may have a top pivotally coupled to the hanger bracket 88. The hanger 800 includes the support rod 81, a cap 85, and an elastic member 86. The cap 85 can move along the support rod 81 in the state in which it has been inserted into the support rod 81. The outer tub 6 is supported by the cap 85, and moves along with the cap 85 in a vibration process.

The support rod 81 may include a support rod base 87 formed at the lower part of the support rod. The base 87 has a form outward extended from the bottom of the support rod 81 in a radial direction. The elastic member 86 provided in the cap 85 is placed on the top surface of the support rod base 87. The elastic member 86 may be a spring. The top of the spring supports the cap 85. Accordingly, the spring 86 is compressed when the cap 85 moves downward while the cap 85 is displaced along with the outer tub 6. The spring 86 restores to its original state in a process of the cap 85 upward moving.

The hanger bracket 88 may be provided near each of the four corners of the cabinet 1 and/or the top cover 2. The four hangers 80 may be coupled to the respective hanger brackets 88. When viewed from top to bottom, the hangers 80 are installed near the four corners of the cabinet 1.

The outer tub 6 may have a top open, and an outer tub cover 7 may be provided at the open top. The outer tub cover 7 may have a ring form having a central part open for the entrance and exit of laundry. The inner tub 5 configured to accommodate laundry and rotated around a vertical axis may be provided in the outer tub 6. A plurality of holes 5*a* through which water pass may be formed in the inner tub 5. Water may move between the inner tub 5 and the outer tub 6 through the holes 5*a*.

A water discharge bellows 18 for discharging water from the outer tub 6 and a water discharge valve 44 for controlling the water discharge bellows 18 may be provided. The water discharge bellows 18 is connected to the pump 100. Water may be supplied to the pump 100 through the water discharge bellows 18 when the water discharge valve 44 is open under the control of a control unit or controller 30. The pump 100 may be construed as operating in the state in which the water discharge bellows 18 is open although not separately described. A pulsator 15 is rotatably provided at the bottom within the inner tub 5. The pulsator 15 may include a plurality of radial ribs that is upward protruded. When the pulsator 15 is rotated, a water current may be formed by the ribs.

A washing motor 41 that provides electric power for rotating the inner tub 5 and the pulsator 15 may be provided in the cabinet 1. The washing motor 41 is provided under the outer tub 6 and may be provided in a form hung in the cabinet 1 along with the outer tub 6. The shaft of the washing motor 41 is always coupled to the pulsator 15, and may be coupled to or released from the inner tub 5 in response to the switch operation of a clutch. Accordingly, when the shaft of the washing motor 41 operates in the state in which it has been coupled to the inner tub 5, the pulsator 15 and the inner tub 5 are rotated together. In the state in which the shaft has been separated from the inner tub 5, the inner tub 5 is in a stop state and only the pulsator 15 is rotated.

Speed of the washing motor 41 can be controlled. The washing motor 41 may be controlled under the control of the control unit 30. The washing motor 41 may be a brushless direct current (BLDC) motor. Speed of the BLDC motor may be controlled using a proportional-integral (PI) controller, a proportional-integral-derivative (PID) controller, etc. Such controllers may receive output of the motor through feedback and control the input current of the motor.

At least one pump is required to drain water from the outer tub 6 or to circulate water through a circulation hose 10. A pump for water discharge and a pump for circulation may be separately provided. Water discharge and circulation may be selectively performed using the single pump 100. The circulation hose 10 functions to guide water, forcibly sent by the pump 100, into a circulation nozzle 12. The circulation hose 10 may have one end connected to a circulation water discharge port 144 and have the other end connected to the circulation nozzle 12.

The circulation water discharge port 144 is protruded in the lateral direction of the pump 100 and coupled to one end of the circulation hose 10. The circulation water discharge port 144 may horizontally extrude and also extend in an upward inclined direction. In the present embodiment, the circulation water discharge port 144 has been illustrated as being backward upward extended.

Figure 6:
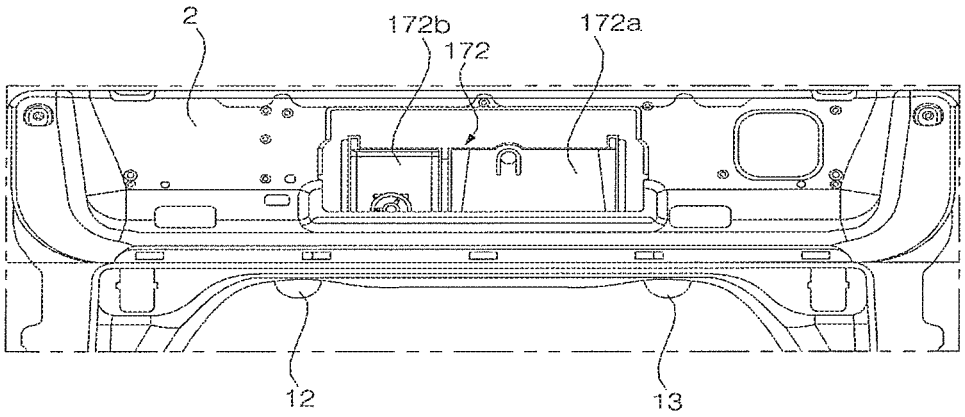
FIG. 6 shows a top cover as viewed from above.
Figure 7:
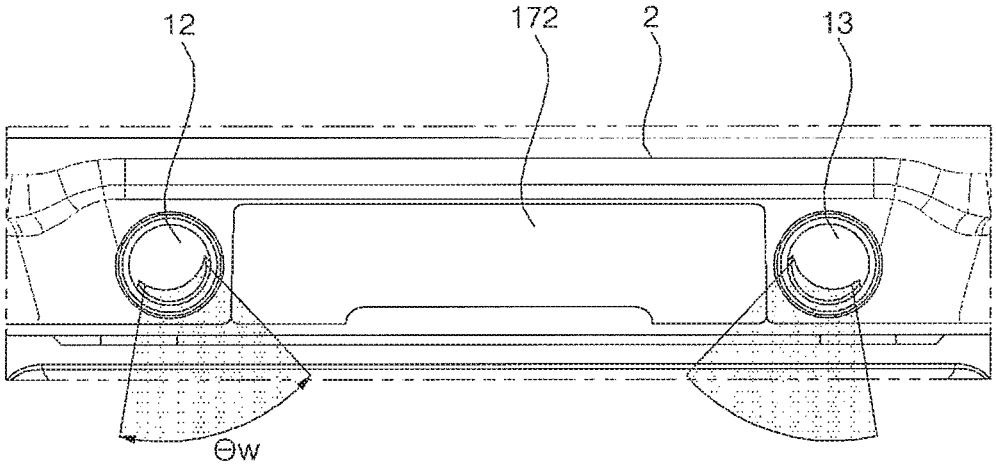
FIG. 7 shows the top cover as viewed from a front.
Figure 17A:
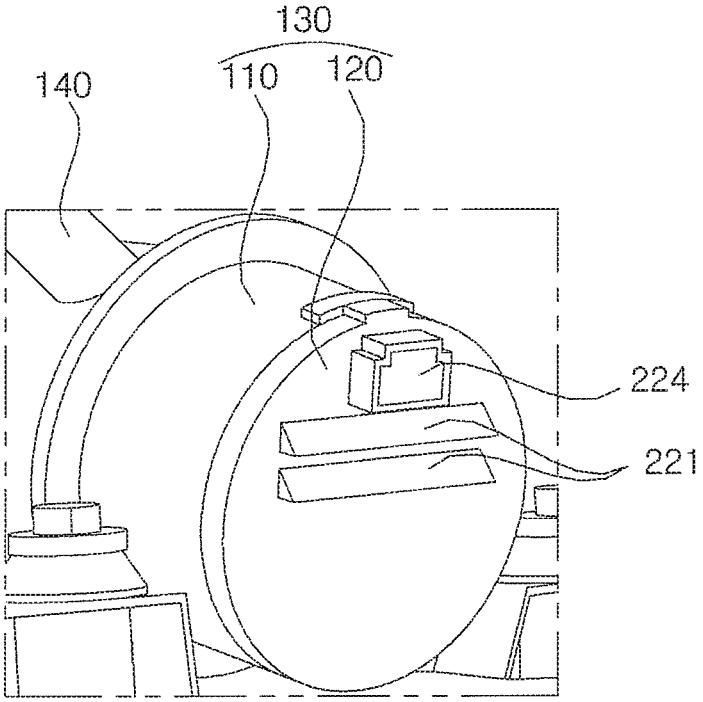
FIG. 17A shows a back part of the pump.
Figure 17B:
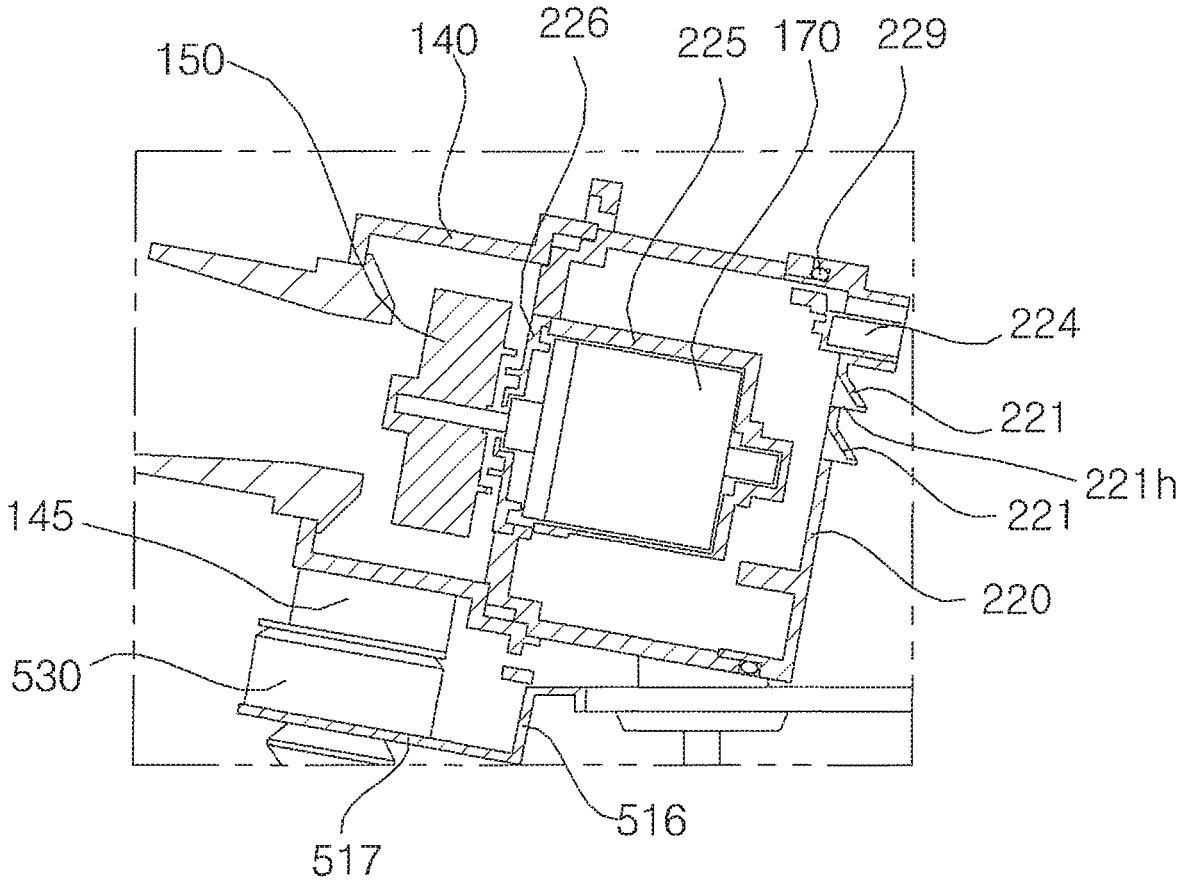
FIG. 17B is a side cross-sectional view of the pump.

The pump 100 may include a pump motor 170 (refer to FIGS. 6 and 17) and an impeller 150 rotated by the pump motor 170 and configured to forcibly send water. The pump motor 170 may be rotated forward/backward. The rotation direction of the impeller 150 is also changed in response to the rotation direction of the pump motor 170. The pump motor 170 is capable of speed control, and may be controlled under the control of the control unit 30. The pump motor 170 may be a brushless direct current (BLDC) motor. Speed of the BLDC motor may be controlled using a proportional-integral (PI) controller, a proportional-integral-derivative (PID) controller, etc. Such controllers may receive output of the motor through feedback and control the input current of the motor.

The pump 100 may include two ports for discharging water forcibly sent by the impeller, that is, a circulation water discharge port 144 and a water discharge port 143. When the pump motor 170 is rotated forward, water is discharged through the circulation water discharge port 144. When the pump motor 170 is rotated backward, water may be discharged through the water discharge port 143.

A dispenser 17 for supplying additives that act on laundry to the inner tub 5 along with water may be provided in the top cover 2. The additives supplied from the dispenser 17 include a detergent and a fabric softener. The dispenser 17 may include a dispenser housing 171 provided in the top cover 2 and a drawer 172 configured to have additives contained therein and received in the dispenser housing 171 in such a way as to be drawn therefrom. A drawer inlet/outlet port through which the drawer 172 passes may be formed in the top cover 2. An opening part corresponding to the drawer inlet/outlet port may be formed on one surface that belongs to the dispenser housing 171 and that faces the drawer inlet/outlet port. The inside of the drawer 172 may be partitioned by a detergent reception unit 172*a* in which a detergent is contained and a fabric softener reception unit 172*b* in which a fabric softener is contained.

A plurality of water supply ports may be formed at the top of the dispenser housing 171. The water supply ports may include a first water supply port 171*a* and a second water supply port 171*b* into which hot water and cold water to be supplied to the detergent reception unit 172*a* are respectively introduced and a third water supply port 171*c* into which cold water or hot water to be supplied to the fabric softener reception unit 172*b* is introduced. Hereinafter, cold water is illustrated as being introduced into the third water supply port 171*c*. In some embodiments, however, hot water may be introduced into the third water supply port 171*c*.

The washing machine may include one or more water supply hoses for guiding water supplied from an external water source, such as a tap. The water supply hoses may include a first water supply hose for guiding water supplied from a cold water source into the first water supply port 171*a*, a second water supply hose for guiding water supplied from a hot water source into the second water supply port 171*b*, a third water supply hose for guiding water supplied from the cold water source into the third water supply port 171*c*, and a fourth water supply hose or a direct water supply hose for supplying water to a direct water nozzle 13.

Cold water may be supplied through the direct water supply hose. The fourth water supply hose may be coupled to a water source such as a tap. The fourth water supply hose may be coupled to the first water supply hose or the third water supply through a fluid connection, but is not limited thereto. Cold water, hot water or a mixture of cold water and hot water may be supplied through the water supply hose.

One or more water supply valves 43 for controlling the water supply hoses may be provided. For example, the one or more water supply valves 43 may include a first water supply valve for controlling the first water supply hose, a second water supply valve for controlling the second water supply hose, a third water supply valve for controlling the third water supply hose, and a fourth water supply valve for controlling the direct water supply hose. The water supply valves may be driven under the control of the control unit 30.

The washing machine may include a water level sensor 42 for sensing a water level in the outer tub 6. The control unit 30 may control the water supply valves 43 and/or the water discharge valve 44 in response to a water level sensed by the water level sensor 42. The control unit 30 may include an input unit or input 46 for receiving the setting of an operation of the washing machine. The input unit 46 may include input means, such as, e.g., keys, buttons and/or a touch panel capable of setting, selecting, and adjusting various types of operation mode provided by the washing machine.

The control panel 3 may include a display, such as a lamp, an LCD panel and/or an LED panel for displaying various types of information such as a response, warning, and notification depending on the operation state of the washing machine and the selection of operation mode. A memory 47 functions to store various data for the operation of the washing machine and may include various recording media, such as volatile/nonvolatile RAM, ROM and/or flash memory.

Referring to FIGS. 6 to 10C, the washing machine may include a circulation nozzle 12 and a direct water nozzle 13, that is, nozzles for spraying water to the inner tub 5. The circulation nozzle 12 and the direct water nozzle 13 may be installed on the top cover 2 and may be provided on both sides with the drawer 172 interposed therebetween. The circulation nozzle 12 and the direct water nozzle 13 may be installed above the outer tub 6. The circulation nozzle 12 may be provided at the back above the outer tub 6.

When viewed from the front, in the case of left and right sides divided based on the dispenser 17, the circulation nozzle 12 may be provided on one side and the direct water nozzle 13 may be provided on the other side. The pump 100 may be provided on the same side as the circulation nozzle 12 based on the dispenser 17 over the base 9. When viewed from the front, the circulation nozzle 12 may be provided on the left of the dispenser 17 and the pump 100 is also provided on the same side as the circulation nozzle 12. However, if the circulation nozzle 12 is provided on the opposite side, the right of the dispenser 17, the pump 100 may also be provided on the right of the dispenser 17.

The circulation nozzle 12 may include a water supply pipe 121 for guiding water supplied through a circulation hose 90 and a diffuser 122 for spraying water, discharged by the water supply pipe 121, to the inner tub 5 by refracting the water downward. The circulation nozzle 12 may be formed of one part made of synthetic resin.

The water supply pipe 121 may be straightly extended from an inlet 121*a* into which water from the direct water supply hose is introduced to an outlet 121*b* for discharging water to the diffuser 122. The outlet 121*b* may have a smaller diameter than the inlet 121*a* so that pressure of water discharged through the outlet 121*b* is increased. A radial protrusion 125 protruded from the outer circumferential surface of the water supply pipe 121. A pair of the radial protrusions 125 may be formed at locations that are symmetrical around the center of the water supply pipe 121. A hose coupling protrusion 126 may extrude from the outer circumferential surface of the water supply pipe 121. A protrusion coupling groove into which the hose coupling protrusion 126 is inserted may be formed on the inner circumferential surface of the circulation hose 10.

The circulation nozzle 12 may include a plate 123 outward extended from the outer circumferential surface of the water supply pipe 121 in the radial direction. The back of the plate 123 faces the front of the top cover 2, and the diffuser 122 may be formed on the front surface of the plate 123. The diffuser 122 may include a collision surface 124 in which water discharged through the outlet 121*b* of the water supply pipe 121 collides against each other and is downward refracted. The diffuser 122 includes a spray hole 122*h* protruded to the front of the plate 123 and configured to spray water into the inner tub 5. That is, the diffuser 122 has a chamber or funnel form depressed from the spray hole 122*h*, and may have an increasing channel section area from the outlet 121*b* of the water supply pipe 121 to the spray hole 122*h*. A portion that belongs to the inside surface of the diffuser 122 forming the chamber and that is placed at the front end of the outlet 121*b* of the water supply pipe 121 is inclined so that water discharged by the outlet 121*b* is downward refracted while colliding against each other. The inclined portion corresponds to the collision surface 124.

The circulation nozzle 12 may further include an inclined part 123*a* protruded from the plate 123 and configured to extend from the side over the spray hole 122*h* to the spray hole 122*h* and to have a slope further protruded from the plate 123 to the spray hole 122*h*. A gap is formed between the end of the inclined part 123*a* and the front surface of the top cover 2. Accordingly, although water flows along the inclined part 123*a* and drops through the spray hole 122*h*, the dropped water can be prevented from coming into contact with the top cover 2. A fixed protrusion 128 may be protruded from the back surface of the plate 123. The fixed protrusion 128 may include a pin 128*a* vertically extended from the back surface of the plate 123 and a head 128*b* configured to have a greater outside diameter than the pin 128*a* and formed at the end of the pin 128*a*.

An opening part 123*h* may be formed in the plate 123. A locking tab 127 may be lengthily protruded from the corner of the opening part 123*h* to the opening part 123*h*. The locking tab 127 has an end of a cantilever form located within the opening part 123*h*, and may be curved from a connection part with the plate 123. A pressurization protrusion 127*a* protruded in a direction to which the back of the plate 123 is directed may be formed at the end of the locking tab 127.

A nozzle mount 2*a* of a backward depressed form may be formed in the front surface of the top cover 2. A first installation hole h1 and a second installation hole h2 of an arc shape spaced apart from the first installation hole h1 and extended in a circumferential direction with respect to a center of the first installation hole h1 or a center of the water supply pipe 121 may be formed in the nozzle mount 2*a*.

The first installation hole h1 may include a circular water supply pipe insertion section h11 configured to have the water supply pipe 121 inserted thereto, first and second radial protrusion insertion sections h12 and h13 extended from the water supply pipe insertion section h11 to both sides in a radial direction thereof, and a pressurization protrusion insertion section h14 further extended from the second radial protrusion insertion section h13 in the radial direction.

The second installation hole h2 may include a head insertion section h21 configured to have the head 128*b* inserted thereto when the radial protrusions 125 is inserted into the first and the second radial protrusion insertion sections h12 and h13, respectively, and a protrusion guide section h22 extended from the head insertion section h21 in a circumferential direction thereof in a width smaller than the width of the head insertion section h21.

A process of installing the circulation nozzle 12 is described below. The locations of radial protrusions 125 are aligned with the radial protrusion insertion sections h12 and h13. The water supply pipe 121 is inserted into the water supply pipe insertion section h11 from the front of the top cover 2. At this time, the head 128*b* of the fixed protrusion 128 is also inserted into the head insertion section h21. The back surface of the plate 123 is placed on the front surface of the top cover 2. The pressurization protrusion 127*a* of the locking tab 127 has closely adhered to the front surface of the top cover 2, and thus the locking tab 127 is elastically curved from a connection part with the plate 123.

When the circulation nozzle 22 is rotated, the head 128*b* moves along the protrusion guide section h22. In this process, the pressurization protrusion 127*a* of the locking tab 127 revolves around the front surface of the top cover 2 in the state in which the pressurization protrusion 127*a* of the locking tab 127 has been deformed. When the pressurization protrusion 127*a* reaches a specific location, it is inserted into the locking tab insertion section h14 and restores to its original form, thereby completing the installation of the circulation nozzle 12.

In the state in which the installation of the circulation nozzle 12 has been installed, the radial protrusion 125 is located on the back surface of the top cover 2. Accordingly, the circulation nozzle 12 does not deviate toward the front side of the first installation hole h1. Furthermore, since the fixed protrusion 128 is also located in the protrusion guide section h22 having a width smaller than the diameter of the head 128*b*, the head 128*b* does not pass through the guide section h22 and the circulation nozzle 12 does not deviate toward the front side of the first installation hole h1. Furthermore, the spray direction of the circulation nozzle 12 may be set as required by properly designing the length of the protrusion guide section h22 and the locations of the locking tab 127 and the insertion section h14 corresponding to the locking tab 127.

Figure 11A:
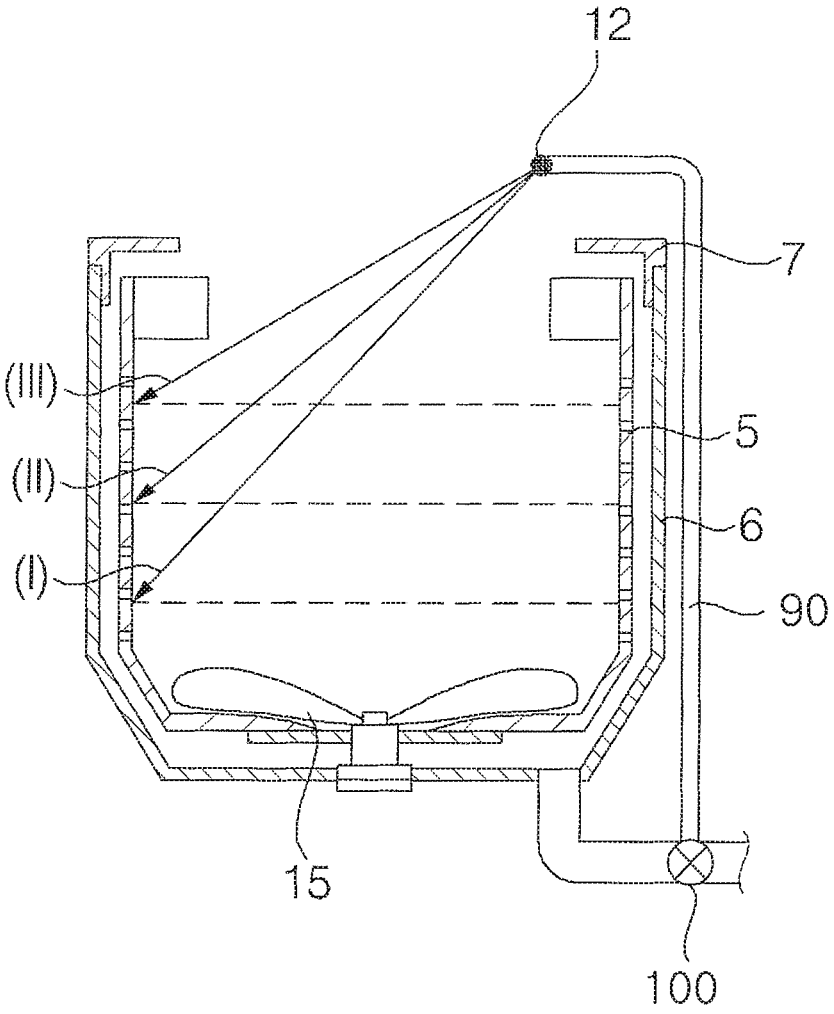
FIG. 11A is a diagram showing heights at which water sprayed through the circulation nozzle reaches the inner tub depending on a rotation speed of a washing motor.
Figure 11B:
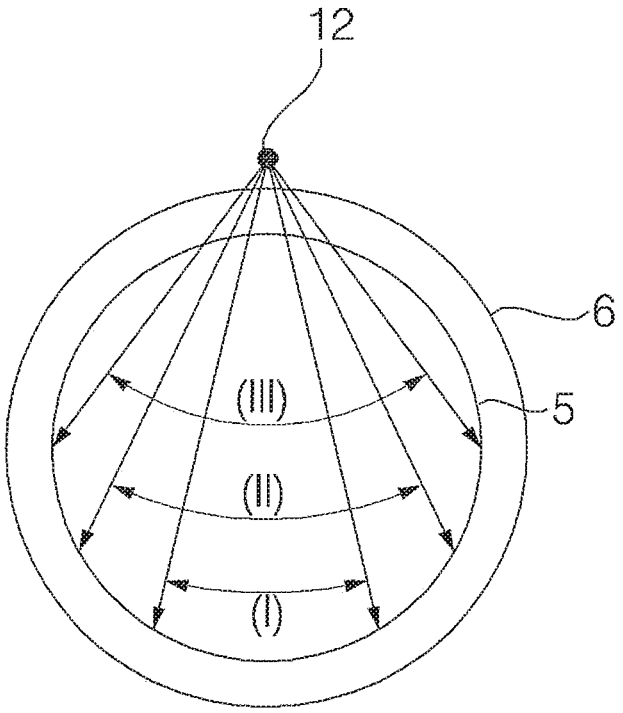
FIG. 11B is a diagram showing angles at which water sprayed through the circulation nozzle is spread in a width direction depending on a rotation speed of the washing motor.
Figure 12:
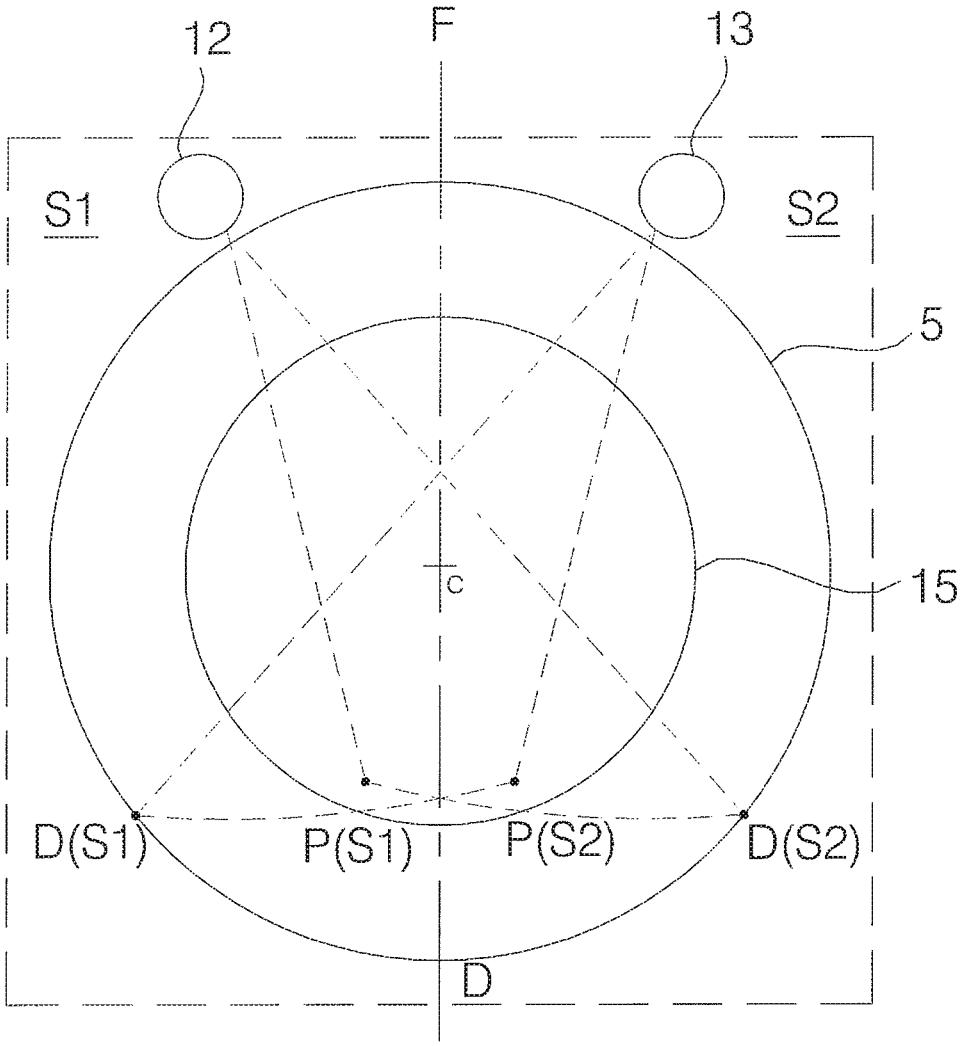
FIG. 12 is a diagram showing spray ranges of the circulation nozzle and a direct water nozzle.

Referring to FIGS. 11A through 12, when water of sufficient water pressure is supplied through the water supply pipe 121, the water sprayed through the spray hole 122*h* may be spread at a maximum spray width angle θw left and right when viewed from the front (refer to FIG. 7) and may be upward sprayed at a maximum vertical spray angle θv with respect to a vertical line when viewed from the side (refer to FIG. 10), but the width of a water current sprayed through the circulation nozzle 12 and a maximum height reached by the water current are reduced as the water pressure supplied through the water supply pipe 121 is reduced.

Water pressure of water supplied through the water supply pipe 121 is changed depending on a rotation speed of the pump motor 170. The control unit 30 may control a form of a water current sprayed through the circulation nozzle 12 by changing a rotation speed of the pump motor 170. In order that the pump motor 170 is rotated at a low speed (I), rotated at a middle speed (II), and rotated at a high speed (III), a maximum height at which a water current sprayed through the circulation nozzle 12 reaches the inner tub 5 is sequentially increased (refer to FIG. 11A) and the horizontal spray angle of the circulation nozzle 12 is sequentially increased (refer to FIG. 11B).

Figure 4:
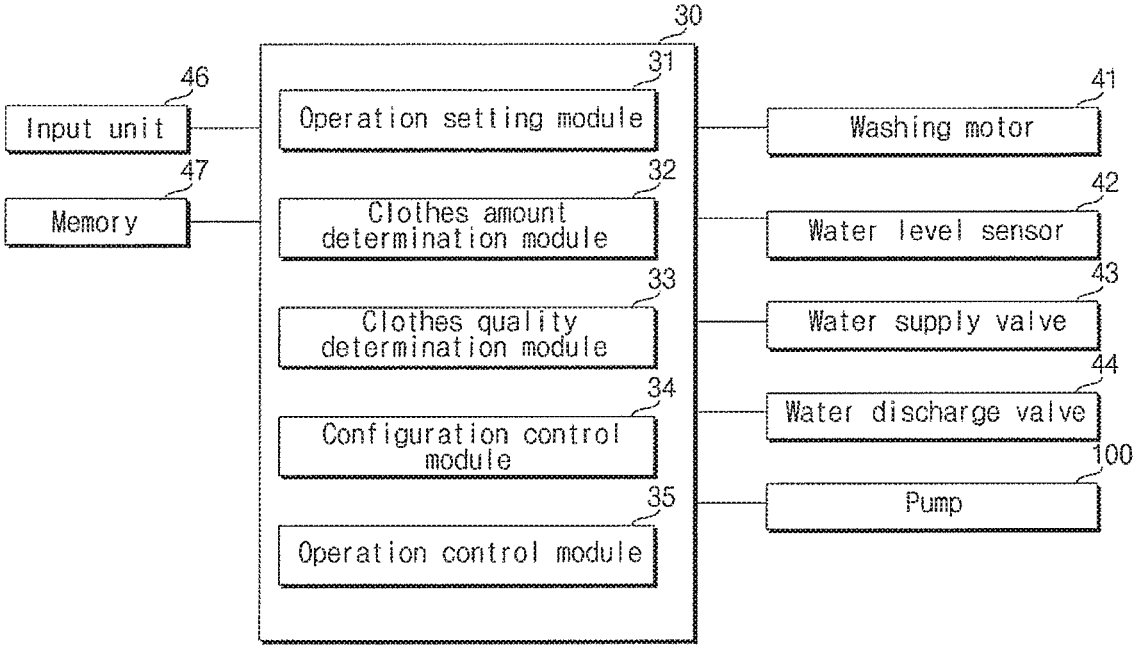
FIG. 4 is a block diagram showing a relationship between elements of the washing machine of FIG. 1.
Figure 5A:
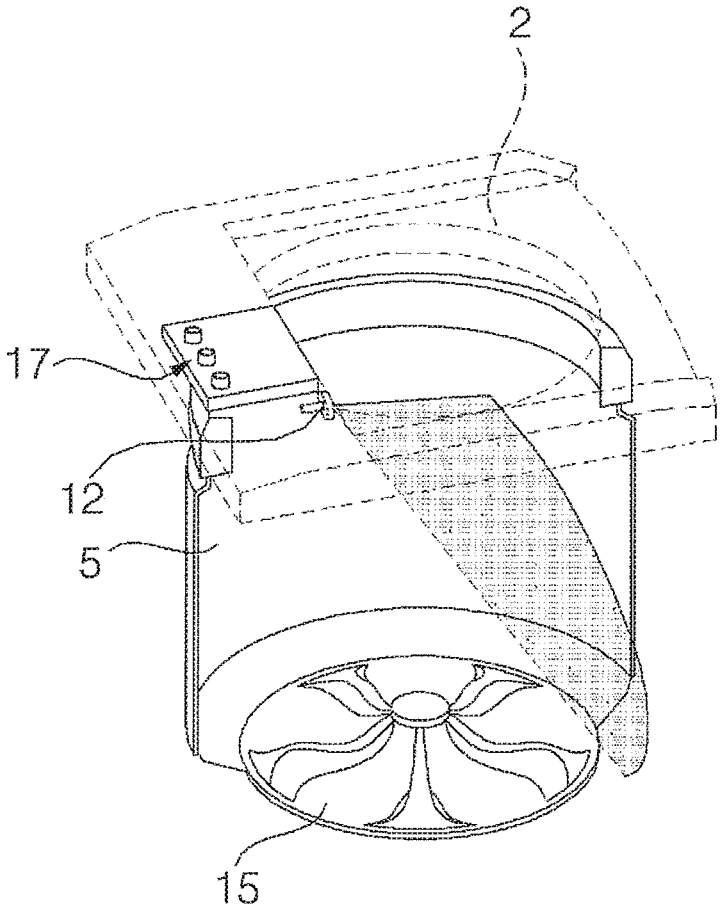
FIG. 5A shows a state in which water is sprayed through a circulation nozzle if an inner tub has no load.
Figure 5B:
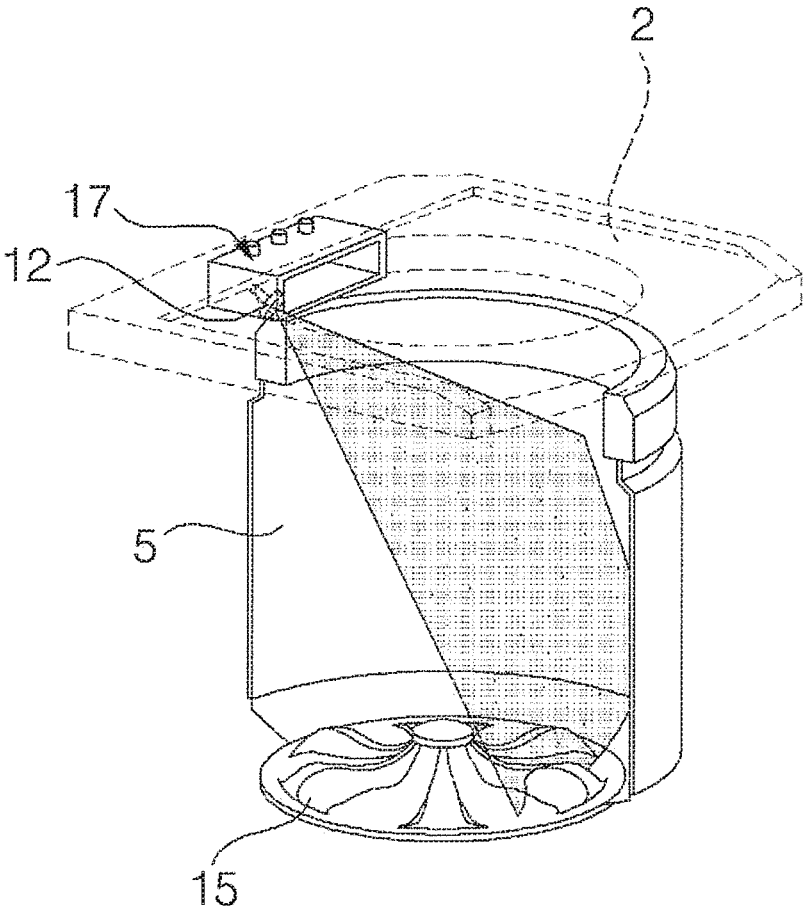
FIG. 5B shows a state in which water is sprayed through the circulation nozzle if the inner tub has a maximum load.

Referring to FIG. 4, the control unit 30 may include an operation setting module 31, a laundry amount determination module 32, a laundry quality determination module 33, a configuration control module 34, and an operation control module 35. The laundry amount determination module 32 may determine an amount of laundry or clothes contained in the inner tub 5, which may be referred to as a "laundry amount". Inertia of the inner tub 5 or the pulsator 15 may be an index for determining a laundry amount. For example, when the inner tub 5 in a stop state is rotated, stop inertia of the inner tub 5 is increased as a laundry amount is increased. Accordingly, more time is taken for the inner tub 5 to reach a set target speed. Accordingly, the laundry amount determination module 32 may determine a laundry amount based on the time taken for the inner tub 5 to the target speed.

For another example, when the rotating inner tub 5 is braked, the laundry amount determination module 32 may determine a laundry amount based on the time taken for the inner tub 5 to stop. In this case, rotation inertia of the inner tub 5 that is changed depending on a laundry amount is used. In addition, a laundry amount may be determined by taking into consideration a change of an input or output current of the washing motor 41 and/or an electromotive force. A method of calculating a laundry amount is widely known to those skilled in the art and a description thereof is omitted, but the laundry amount determination module 32 may determine a laundry amount using various known methods.

The operation control module 32 may control various electronic devices, such as the washing motor 41, the water supply valve 43, the water discharge valve 44, and the pump motor 170. The operation control module 32 may control the electronic devices based on a water level sensed by the water level sensor 42 or a laundry amount determined by the laundry amount determination module 31.

The operation control module 32 may control the water supply valve 43 so that water is supplied to the inner tub 5, and then may control a rotation speed of the pump motor 170 based on a laundry amount determined by the laundry amount determination module 31. For example, the operation control module 32 may increase the rotation speed of the pump motor 170 as the laundry amount determined by the laundry amount determination module 31 increases. If the amount of laundry thrown into the inner tub 5 is large, the operation control module 32 increases the maximum spray width angle θw and the maximum vertical spray angle θv by increasing spray water pressure of the circulation nozzle 12.

The operation control module 32 may continue to rotate the washing motor 41 in one direction while the pump motor 170 is rotated. At this time, the washing motor 41 may be rotated at a sufficient speed to the extent that it is rotated along with the inner tub 5 in the state in which laundry within the inner tub 5 have adhered or attached to the inside surface of the inner tub, that is, a drum D (refer to FIG. 12), by a centrifugal force. In this case, there is an advantage in that water sprayed through the circulation nozzle 12 can dampen laundry uniformly.

Figure 8A:
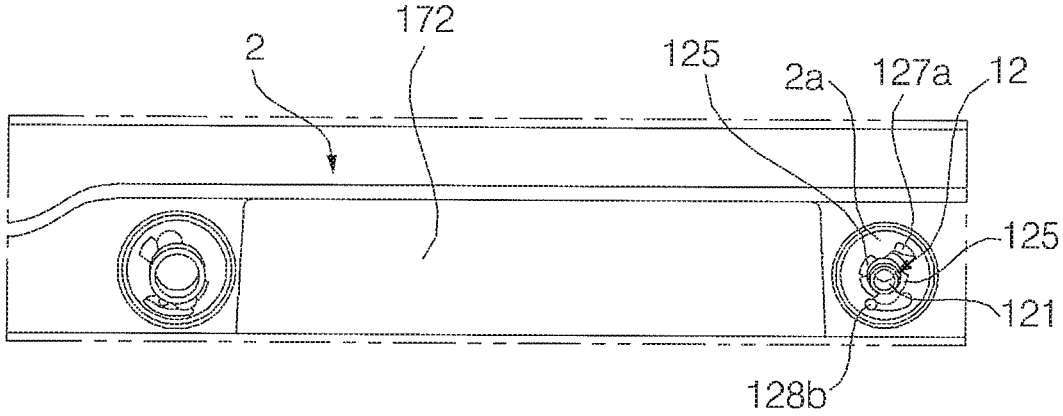
FIG. 8A shows a back of the top cover in which the circulation nozzle has been installed.
Figure 8B:
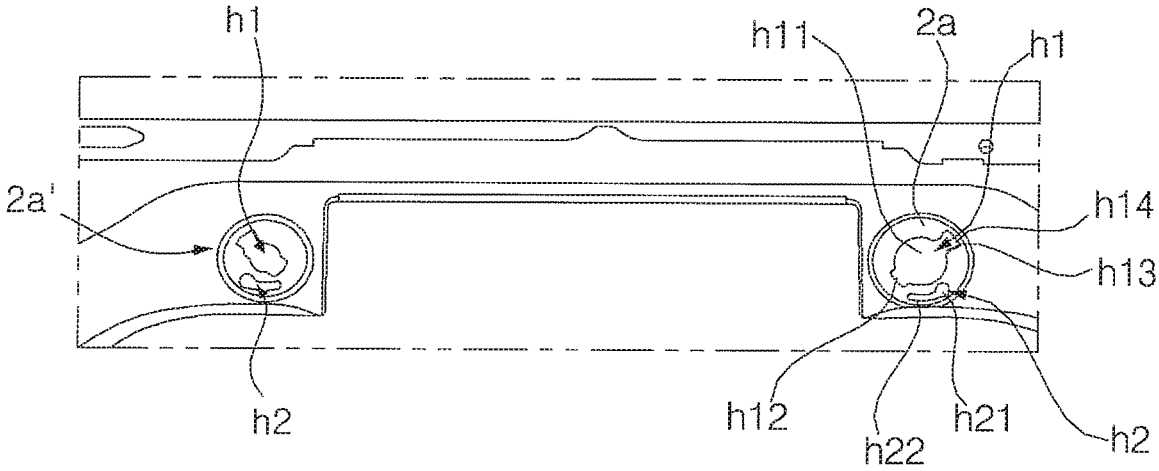
FIG. 8B shows the back of the top cover in which the circulation nozzle has been separated.
Figure 9A:
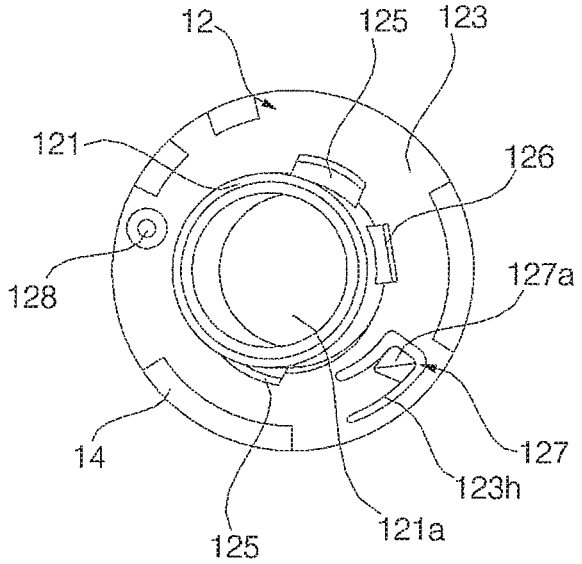
FIG. 9A shows a back part of the circulation nozzle.
Figure 9B:
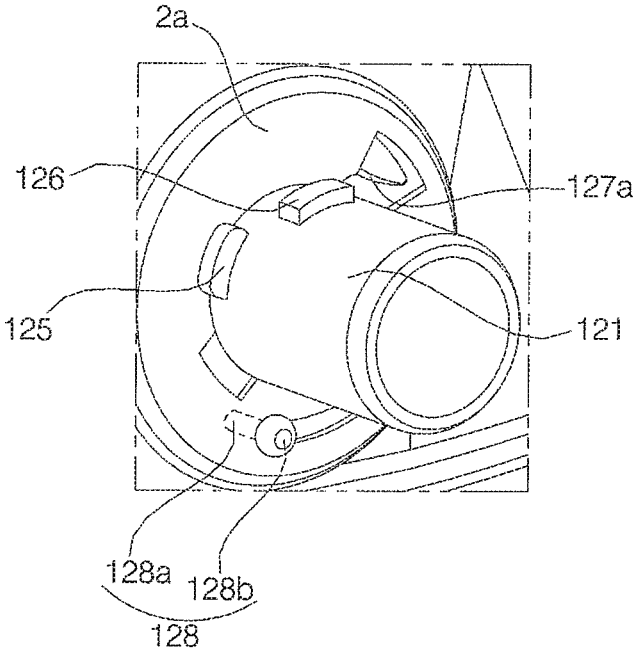
FIG. 9B shows a coupling structure of the top cover and the circulation nozzle.
Figure 10A:
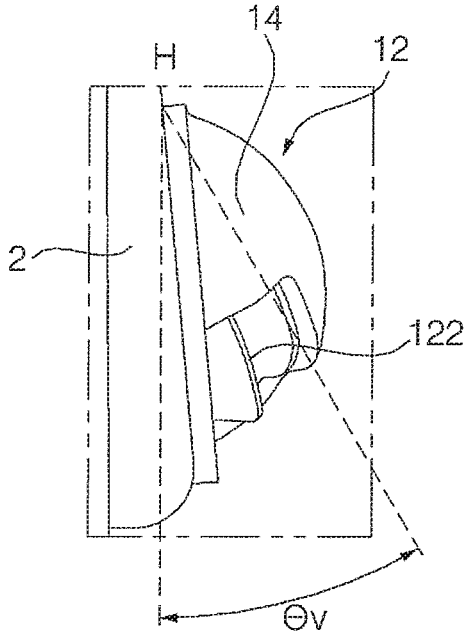
FIG. 10A shows that the circulation nozzle and a nozzle cap assembly installed on the top cover as viewed from a side.
Figure 10B:
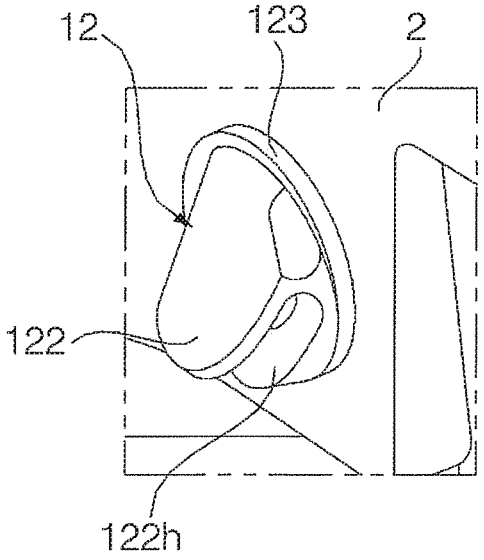
FIG. 10B is a perspective view showing the circulation nozzle installed on the top cover.
Figure 10C:
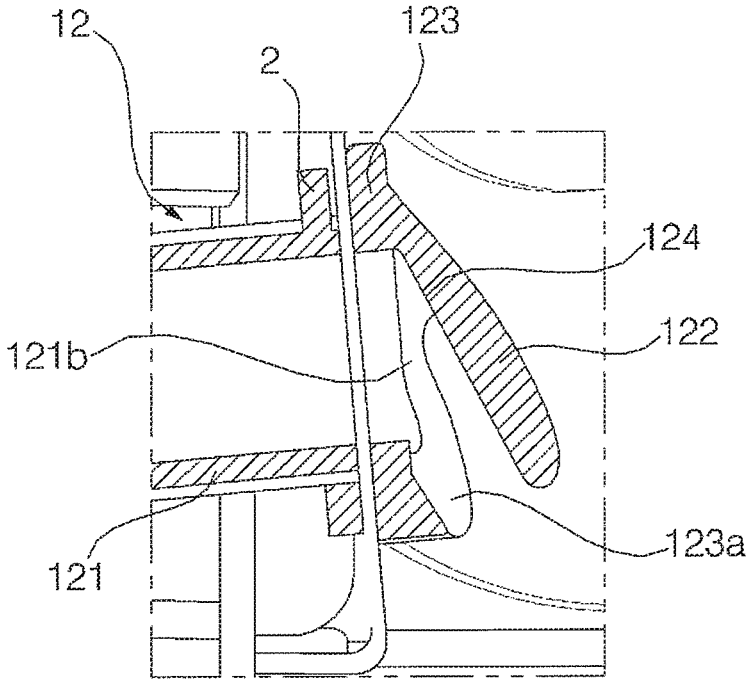
FIG. 10C is a side cross-sectional view of the circulation nozzle.

The direct water nozzle 13 may have substantially the same structure as the circulation nozzle 12. A nozzle mount 2*a*' on which the direct water nozzle 13 is to be installed may be formed in the top cover 2. The nozzle mount 2*a*' has substantially the same structure as the nozzle mount 2*a*, but as shown in FIG. 8, the first installation hole h1 and the second installation hole h2 may have a mirror symmetry form compared to the nozzle mount 2*a*.

A nozzle cap 14 may be coupled to each of the circulation nozzle 12 and the direct water nozzle 13. The nozzle cap 14 is configured to surround the diffuser 122 of each of the nozzles 12 and 13, and includes an opening part communicating with each of the spray holes of the nozzles 12 and 13. The nozzle cap 14 may be coupled to the plate 123.

Referring to FIG. 12, assuming that one side of a vertical plane to which the rotational axis c of the inner tub 5 belongs is a first region S1 and the other side thereof is a second region S2 based on a reference surface F extended in the front and rear direction, the circulation nozzle 12 may be provided in the first region S1 and may spray water so that it reaches the second region S2, and the direct water nozzle 13 may be provided in the second region S2 and may spray water so that it reaches the first region S1. That is, at least part of the spray hole of the circulation nozzle 12 may be open toward the second region S2, and at least part of the spray hole of the direct water nozzle 13 may be open toward the first region S1.

The inner tub 5 may include a bottom on which the pulsator 15 is provided and a cylindrical drum upward extended from the bottom. The spray hole of the circulation nozzle 12 may be open toward a region that reaches from a first part P(S1) on the top of the pulsator 15 belonging to the first region S1 to a second part D(S2) on the inner circumferential surface of the drum belonging to the second region S2 in the state in which the inner tub 5 is an unloaded state (e.g., the state in which laundry have not been thrown).

The spray hole of the direct water nozzle 13 may be open toward a region that reaches from a third part P(S2) on the top of the pulsator 15 belonging to the second region S2 to a fourth part D(S1) on the inner circumferential surface of the drum belonging to the first region S1 in the state in which the inner tub 5 is an unloaded state.

Figure 13:
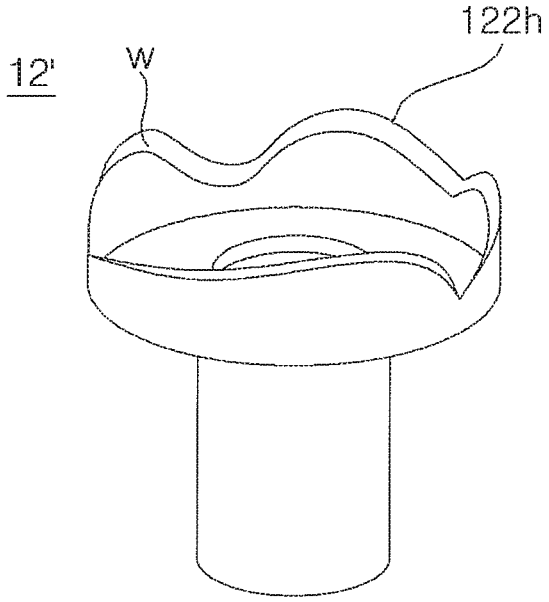
FIG. 13 shows a circulation nozzle according to another embodiment.

FIG. 13 shows a circulation nozzle according to another embodiment. Referring to FIG. 13, the circulation nozzle 12' according to another embodiment of the present disclosure has the same configuration as the circulation nozzle 12 according to the previous embodiment except that part of the spray hole 122*h* forms a wave form W. For example, the wave form W may be formed at the bottom of the collision surface 124 that forms the spray hole 122*h*.

Referring to FIGS. 14 to 17, the pump 100 may include a motor casing 130 configured to have the pump motor 170 received therein and a pump housing 140 configured to form the space in which the impeller 150 is received therein, or an "impeller reception space", and coupled to the motor casing 130. The impeller 150 may include a plurality of vanes 151 that are radially provided. Four vanes 151 may be provided, but the number of vanes is not necessarily limited thereto.

The pump housing 140 may include a housing main body 141 configured to form the impeller reception space, a supply port 142 forward extended from the housing main body 141 and configured to communicate with the impeller reception space, and two ports, that is, the circulation water discharge port 144 and the water discharge port 143 configured to discharge water, forcibly sent by the impeller 150, to the outside of the impeller reception space. The circulation water discharge port 144 and the water discharge port 143 may be outward extended from the housing main body 141.

The circulation water discharge port 144 may be formed to have substantially the same inside diameter as the water discharge port 143, but is not necessarily limited thereto. In some embodiments, the circulation water discharge port 144 may be formed to have a smaller inside diameter than the water discharge port 143. The supply port 142 may be coupled to the water discharge bellows 18. The supply port 142 may be formed of a pipe extended in an axial direction in which the impeller 150 is rotated. Water discharged from the outer tub 6 to the water discharge bellows 18 may be supplied to the impeller reception space through the supply port 142.

A water discharge outlet 143*a* corresponding to the inlet of the water discharge port 143 and a circulation water outlet 144*a* corresponding to the inlet of the circulation water discharge port 144 may be formed on an inside surface 147 (refer to FIG. 15) of a ring shape having a clearance between the pump housing 140 and the impeller 150. The inside surface 147 forms the inner circumferential surface of the housing main body 141. The water discharge outlet 143*a* and the circulation water outlet 144*a* may be spaced apart from at a specific interval in a circumferential direction thereof on the inside surface 147. The water discharge outlet 143*a* and the circulation water outlet 144*a* may be located in the range S between approximately 140 to 170 degrees around the shaft of the impeller 150. In this case, the range S is an angle formed by one end 144*a*1 of the circulation water outlet 144*a* and one end 143*a*1 of the water discharge outlet 143*a* around the shaft of the impeller 150 as in FIG. 15. Furthermore, the other end 144*a*2 of the circulation water outlet 144*a* and the other end 143*a*2 of the water discharge outlet 143*a* may form an acute angle around the shaft of the impeller 150. An angle θp formed by the water discharge port 143 and the circulation water discharge port 144 may be approximately 30 to 90 degrees.

When the pump motor 170 is rotated forward, water may be supplied to the circulation hose 90 through the circulation water discharge port 144. When the pump motor 170 is rotated backward, water may be supplied to the water discharge hose 11 through the water discharge port 143. In order for water discharge and the circulation operation of water to be accurately performed, when water is discharged through the circulation water discharge port 144, it should not be discharged through the water discharge port 143 needs to be prevented. In contrast, when water is discharged through the water discharge port 143, it should not be prevented through the circulation water discharge port 144. To this end, when the impeller 150 is rotated forward, the circulation water outlet 144*a* is formed at a location higher than the water discharge outlet 143*a* on the upstream side of a water current. Accordingly, the water discharge outlet 143*a* Is located on the downstream side of a water current with respect to the circulation water outlet 144*a*.

The circulation water discharge port 144 and the water discharge port 143 are extended from the circulation water outlet 144*a* and the water discharge outlet 143*a*, respectively, to the outward direction of the housing main body 141, but the circulation water discharge port 144 is extended forward or a direction inclined toward the downstream side with respect to the forward direction and the water discharge port 143 is extended backward or a direction inclined toward the upstream side with respect to the forward direction.

Figure 14A:
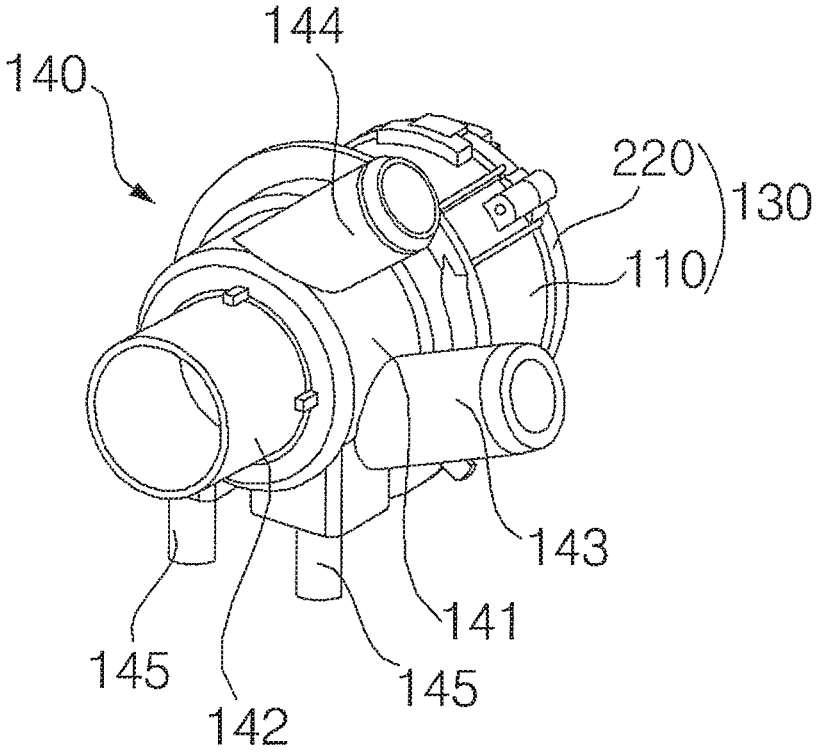
FIG. 14A is a perspective view of a pump.
Figure 14B:
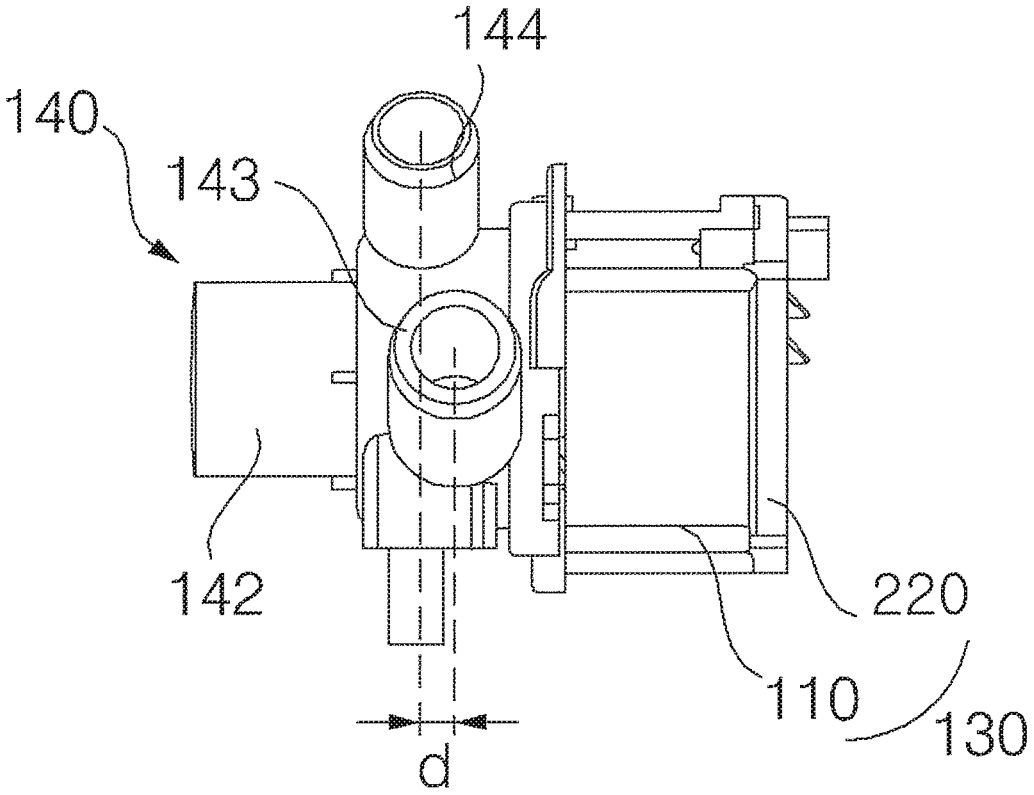
FIG. 14B is a side view of the pump.
Figure 14C:
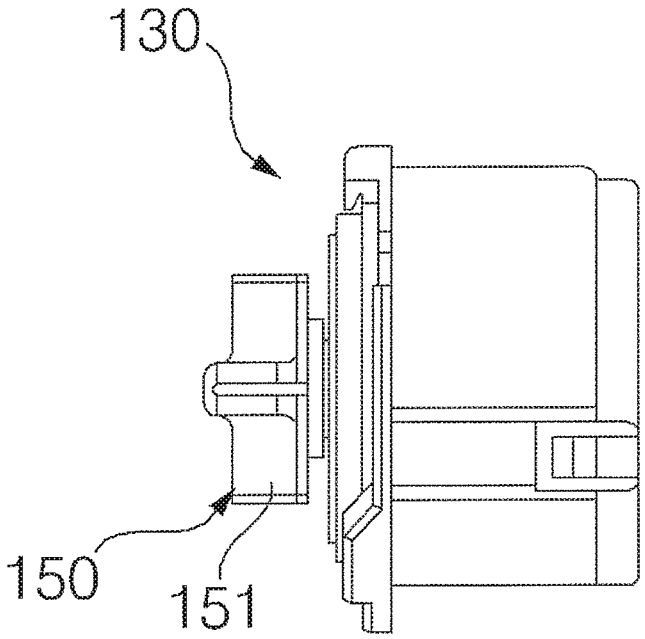
FIG. 14C shows a state in which a pump housing has been removed from the pump.
Figure 14D:
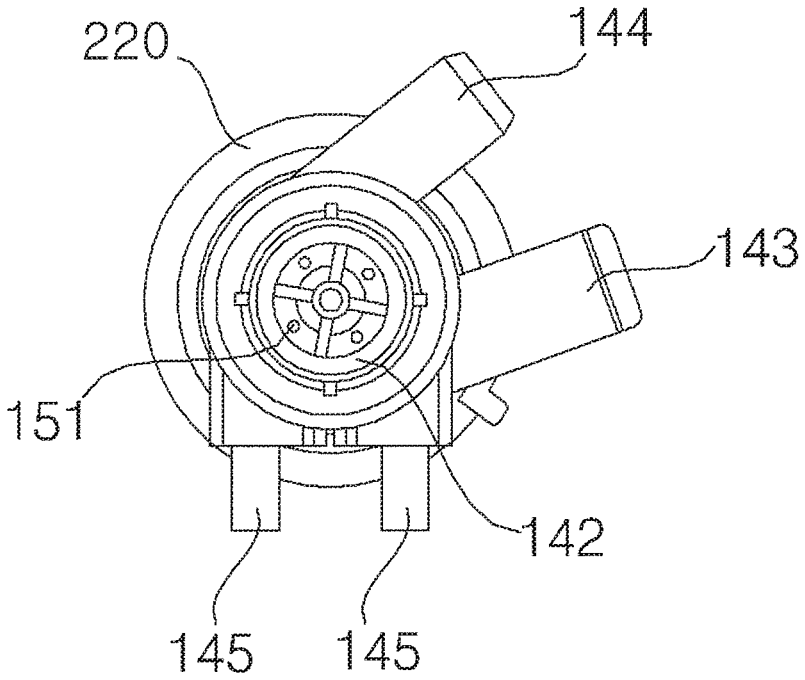
FIG. 14D is a front view of the pump.

As shown in FIG. 14B, when the pump 100 is viewed from the side, for example, along the shaft of the impeller 150, the center of the circulation water outlet 144*a* and the center of the water discharge outlet 143*a* may be spaced apart from each other at a specific interval "d" in the axial direction of the pump motor 170. When the pump motor 170 is rotated forward, a water discharge prevention rib 146 for preventing water in the pump housing 140 from being discharged to the water discharge hose 11 through the water discharge outlet 143*a* may be protruded from the inside surface 147 of the pump housing 140. When the pump motor 170 is rotated backward, a circulation water discharge prevention rib 148 for preventing water in the pump housing 140 from being discharged to the circulation hose 90 through the circulation water outlet 144*a* may be protruded from the inside surface 147 of the pump housing 140.

Figure 15:
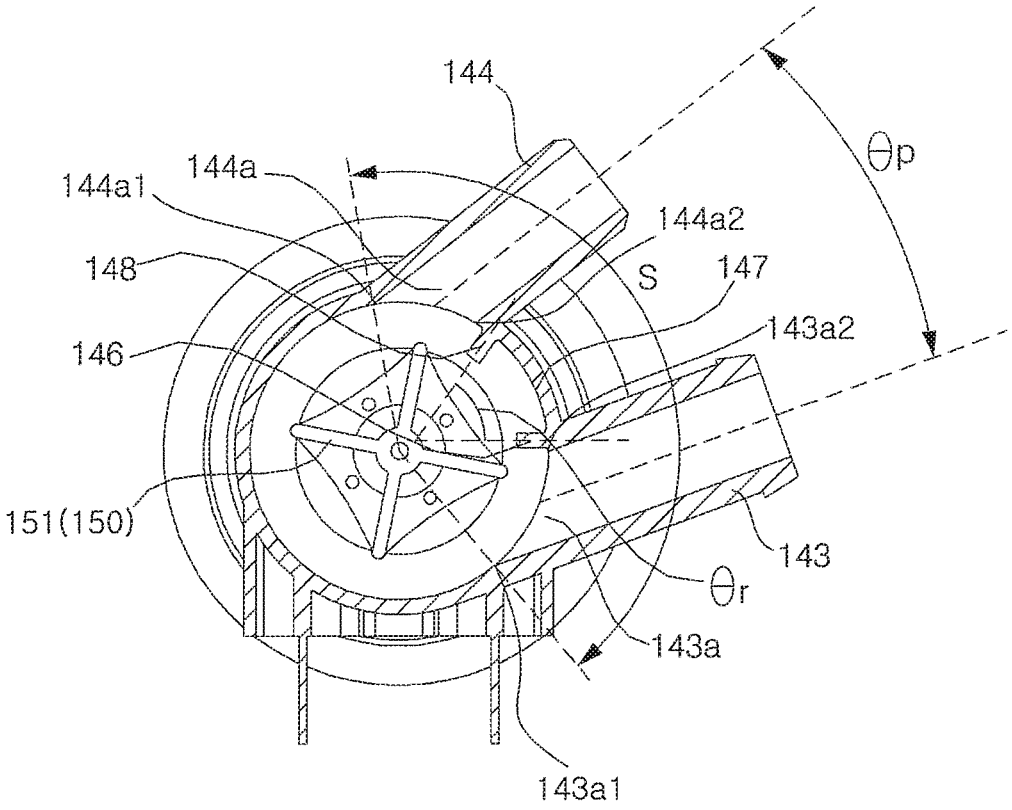
FIG. 15 shows a cut out view of the inside of the pump housing.
Figure 16:
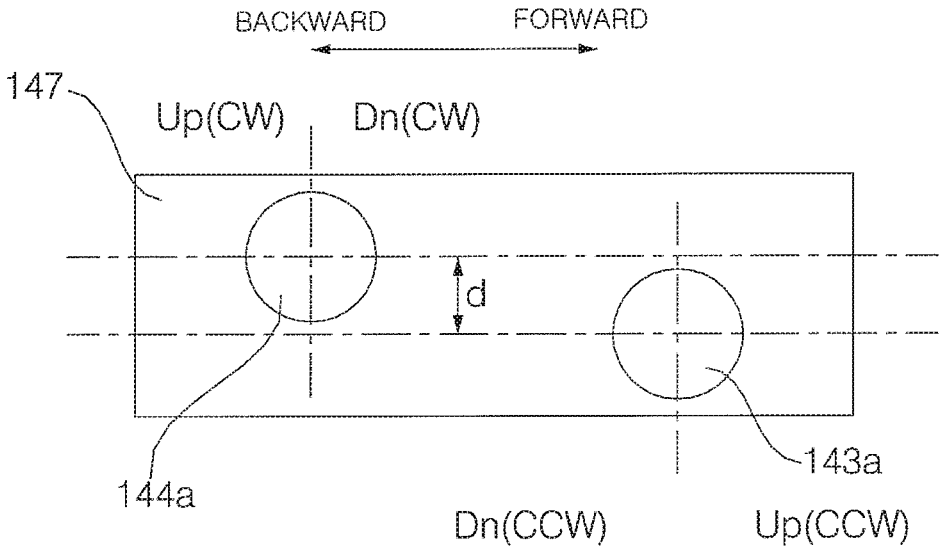
FIG. 16 shows an inside surface of the pump housing.

FIG. 16 shows that the upstream side Up(CW) and downstream side Dn(CW) of the circulation water outlet 144*a* have been defined based on a water current when the pump motor 170 is rotated forward and the upstream side Up(CCW) and downstream side Dn(CCW) of the water discharge outlet 143*a* have been defined based on a water current when the pump motor 170 is rotated backward. In accordance with such a definition, in FIG. 15, the water discharge prevention rib 146 may be formed to be adjacent to the water discharge outlet 143*a* on the downstream side Dn(CCW), and the circulation water discharge prevention rib 148 may be formed to be adjacent to the circulation water outlet 144*a* on the downstream side Dn(CW).

The water discharge prevention rib 146 may be formed at the corner of the water discharge outlet 143*a*, and the circulation water discharge prevention rib 148 may be formed at the corner of the circulation water outlet 144*a*. The water discharge prevention rib 146 and the circulation water discharge prevention rib 148 are formed within an interval between the impeller 150 and the inside surface 147 of the pump housing 140. The end of each of the ribs 146 and 148 maintains a specific interval from the vane 151 of the impeller 150.

At least one of the water discharge prevention rib 146 and the circulation water discharge prevention rib 148 may be protruded in a length of approximately 3 to 6 mm from the inside surface 147 of the pump housing 140. Accordingly, the interval between the impeller 150 and the inside surface 147 may be greater than the protruded length.

For example, at least one of the water discharge prevention rib 146 and the circulation water discharge prevention rib 148 may form an acute angle along with the inside surface 147. For example, an angle θr formed by the water discharge prevention rib 146 and the circulation water discharge prevention rib 148 may be 5 to 85 degrees. In accordance with experiments performed by the applicant, it was found that the water discharge prevention rib 146 and the circulation water discharge prevention rib 148 are vertically protruded from the inside surface 147 and an angle formed by both the ribs 146 and 148 is 40 degrees, whereas if both the ribs 146 and 148 and the inside surface 147 form an oblique angle and an angle formed by both the ribs 146 and 148 is 80 degrees as shown in FIG. 15, the amount of water that leaks to the circulation water discharge port 144/water discharge port 143 upon water discharge/circulation is reduced.

The motor casing 130 may be coupled to the pump housing 140. The pump housing 140 has an opening part formed on the side opposite the side of the supply port 142, and the motor casing 130 is coupled to the pump housing 140. Accordingly, the opening part can be shielded. A ring-shaped sealer 229 may be interposed along the coupling part of the motor casing 130 and the pump housing 140.

The motor casing 130 may include a casing body 110 and a rear cover 220. A motor housing 225 in which the pump motor 170 is received may be provided on the inside of the casing body 110. The motor casing 130 may have a cylindrical shape backward extended from a front part 226 through which the shaft of the motor 170 passes. The open rear end part of the motor housing 225 may be coupled to the rear cover 220.

The front part of the motor housing 225 may be open so that the pump motor 170 is inserted into the motor housing 225. The open portion of the motor housing 225 may be coupled to the front part 226 of the casing body 110. One or more heat dissipation hole 221*h* may be formed in the rear cover 220. A shield plate 221 for blocking dropping water from entering the heat dissipation hole 221*h* may be formed above the heat dissipation hole 221*h*. The shield plate 221 may be inclined downward. Furthermore, a power connector 224 for connecting the pump motor 170 and a power line may be formed in the rear cover 220.

Figure 18:
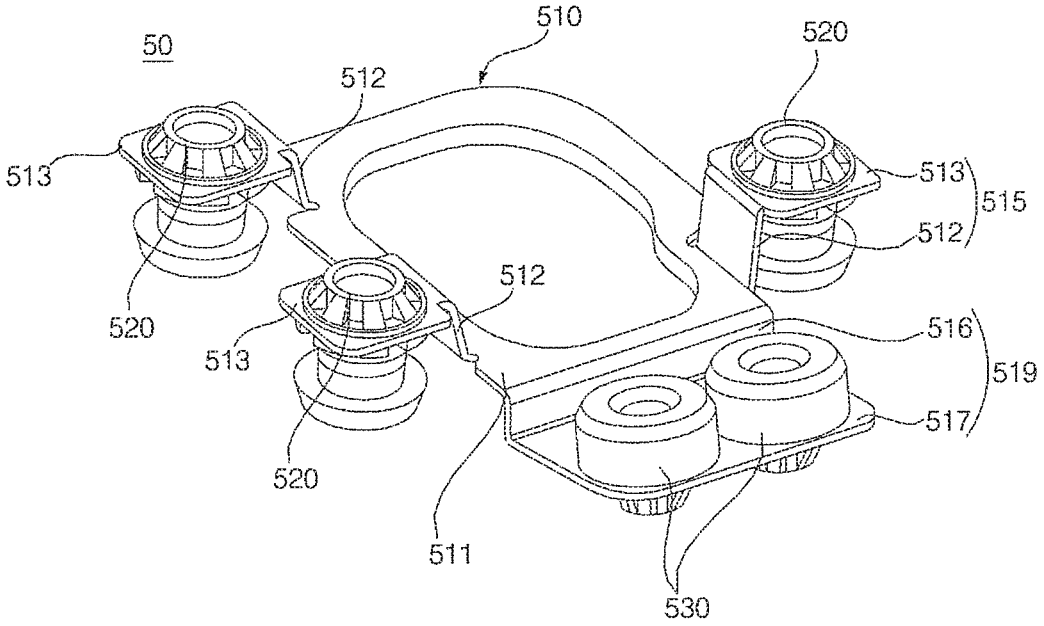
FIG. 18 is a perspective view of a pump bracket.
Figure 19:
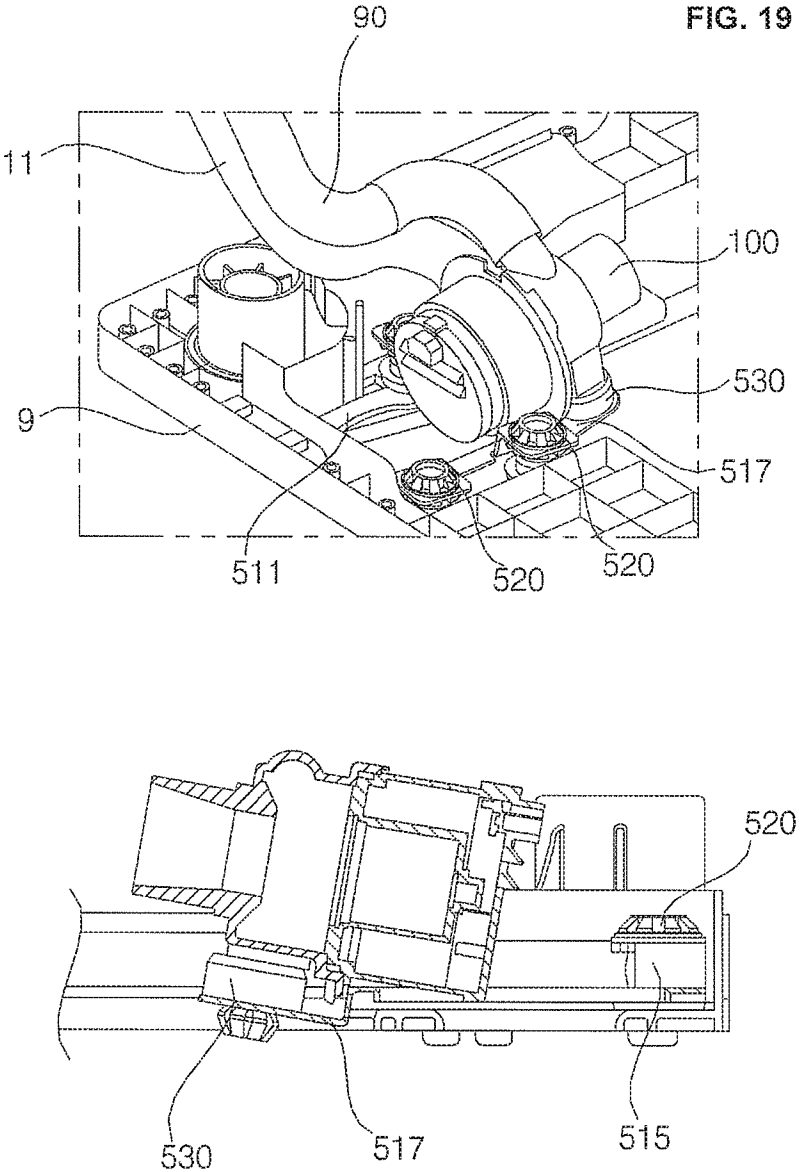
FIG. 19 shows the pump installed on a base in various aspects.

Referring to FIGS. 18 and 19, the pump 100 may be coupled to the base 8 by a pump supporter 50. The pump supporter 50 may include a plate 510 made of metal, plate support dampers 520 installed on the plate 510, and pump support dampers 530 provided in the plate 510 and configured to support legs 145 formed in the pump 100. Three plate support dampers 520 may be provided in a triangular structure.

The plate support dampers 520 and/or the pump support dampers 530 may be made of an elastic material such as rubber. Accordingly, vibration caused when the pump 100 is driven can be absorbed by the dampers 520 and 530.

The plate 510 may include a horizontal flat part 511, a plate support damper mount 515 upward extended from the flat part 511, and a pump support damper mount 519 downward extended from the flat part 511. The plate support damper mount 515 may include an upper vertical unit 512 upward curved from the flat part 511 and an upper horizontal unit 513 horizontally curved from the upper vertical unit 512 to the outside of the flat part 511 and configured to have a hole in which the plate support dampers 520 is provided formed in. The plate support damper 520 has its lower part coupled to the base 8 in the state in which they have been fixed on the upper horizontal unit 513.

The pump support damper mount 519 may include a lower vertical part 516 downward curved from the flat part 511 and a lower horizontal part 517 horizontally curved from the lower vertical part 516 to the outside of the flat part 511 and configured to have a hole in which the pump support damper 530 is provided formed therein. The pump 100 may include the pair of legs 145 downward protruded from the pump housing 140. The pump support dampers 530 have their upper parts coupled to the legs 145 of the pump 100 in the state in which they have been fixed on the lower horizontal part 517.

Figure 20:
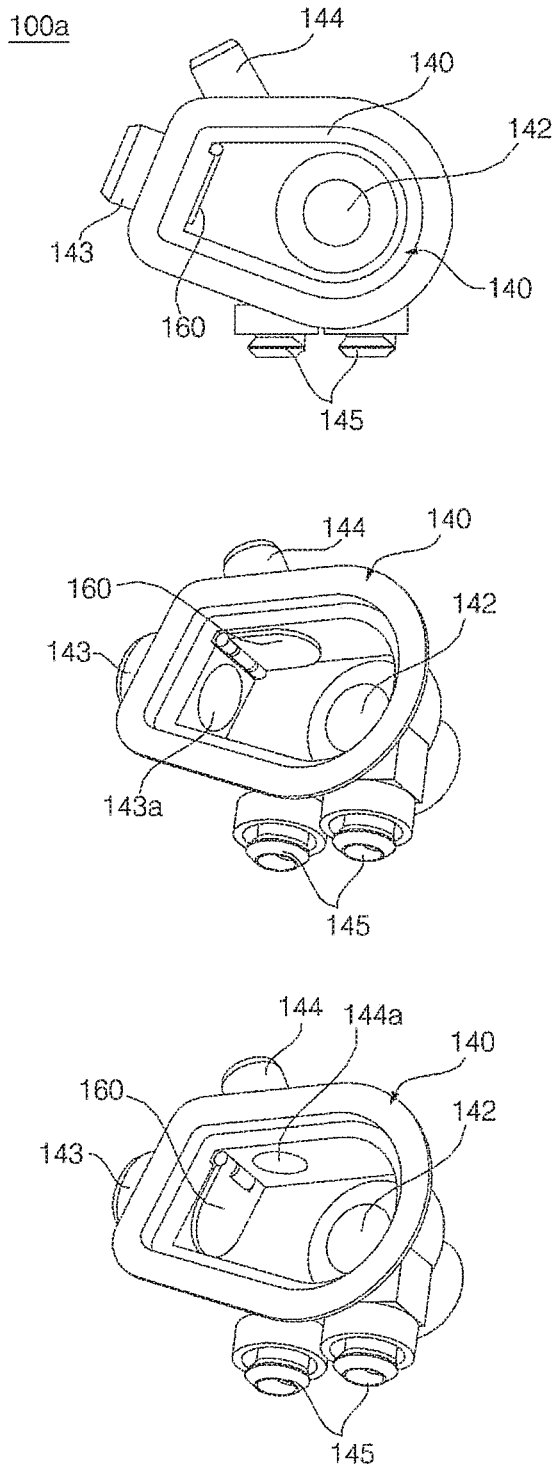
FIG. 20 shows a pump according to another embodiment.

FIG. 20 shows a pump 100*a* according to another embodiment. Hereinafter, same reference numerals may be assigned to same elements as those of aforementioned embodiments, and a description of the elements may be omitted. Referring to FIG. 20, the pump 100*a* may include a check valve 160 rotatably connected to the inside surface 147 of the pump housing 140 and configured to shut the water discharge outlet 143*a* when the pump motor 170 is rotated forward and to shut the circulation water outlet 144*a* when the pump motor 170 is rotated backward.

The check valve 160 is driven by a water current formed by the impeller 150. The check valve 160 may have its shaft, connected to the inside surface 147 of the pump housing 140, formed substantially parallel to the shaft of the impeller 160. The shaft of the pump housing 140 may be located between the circulation water outlet 144*a* and the water discharge outlet 143*a*. Accordingly, the rotation direction of the impeller 160 becomes opposite that of the check valve 160. When the impeller 160 is rotated forward, the water discharge outlet 143*a* is located on the downstream side of a water current compared to the circulation water outlet 143*a*. Accordingly, when the impeller 160 is rotated forward, the water discharge outlet 143*a* maintains a shutting state by the check valve 160. In this state, when the rotation direction of the impeller 160 is reversed, the check valve 160 is rotated forward, the water discharge outlet 143*a* is open, and the circulation water outlet 144*a* is open.

The check valve 160 may be made of a soft material, such as rubber, having some elasticity. A surface that belongs to the check valve 160 and that comes into contact with the inside surface 147 of the pump housing 140 may be formed flat. Furthermore, the peripheral portions of the circulation water outlet 144*a* and the water discharge outlet 143*a*, which come into contact with the check valve 160, in the inside surface 147 of the pump housing 140 may be formed flat. Unwanted leakage from the pump 100*a* can be prevented because the check valve 160 shuts the water discharge outlet 143*a* or the circulation water outlet 143*a* in response to the rotation direction of the pump motor 170.

Figure 21A:
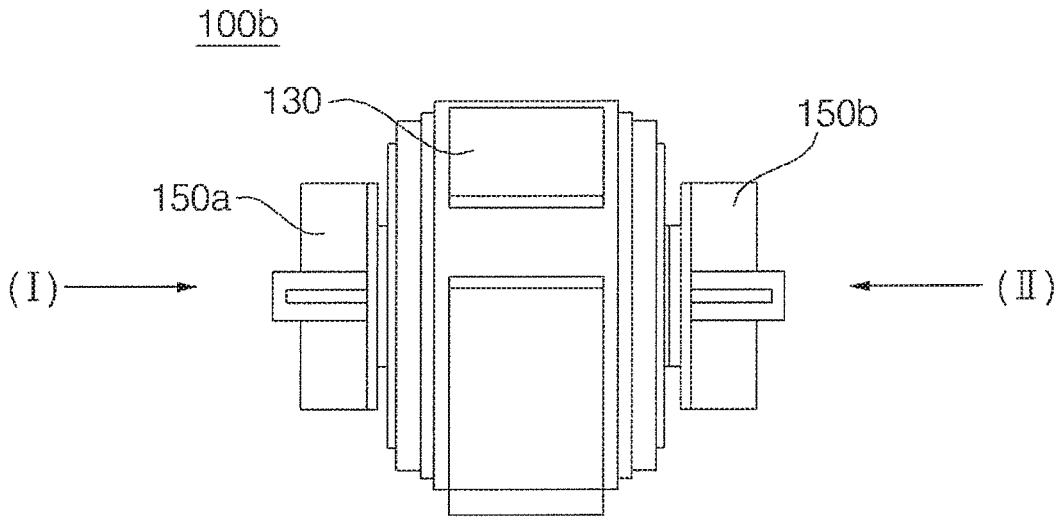
FIG. 21A shows a pump in which a first pump housing and a second pump housing have been removed.
Figure 21B:
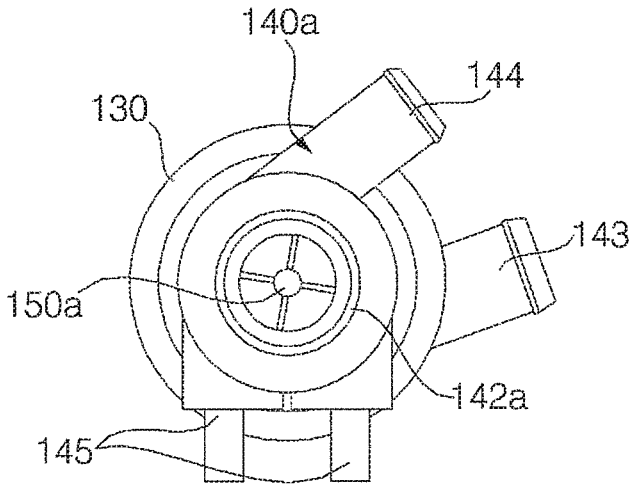
FIG. 21B shows the pump viewed in a direction I indicated in FIG. 21A in the state in which the first pump housing and the second pump housing have been assembled.
Figure 21C:
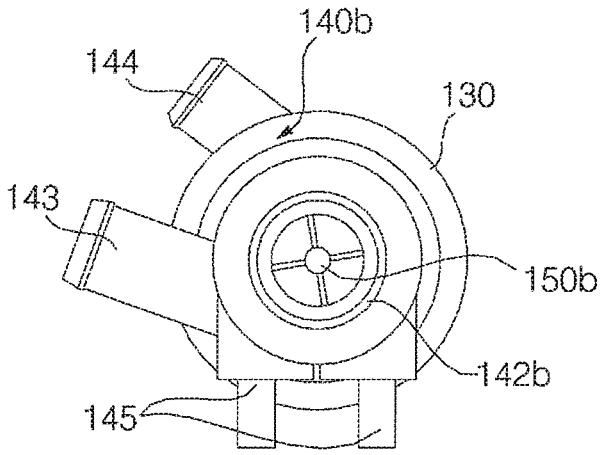
FIG. 21C shows the pump viewed in a direction II indicated in FIG. 21A in the state in which the first pump housing and the second pump housing have been assembled.
Figure 22A:
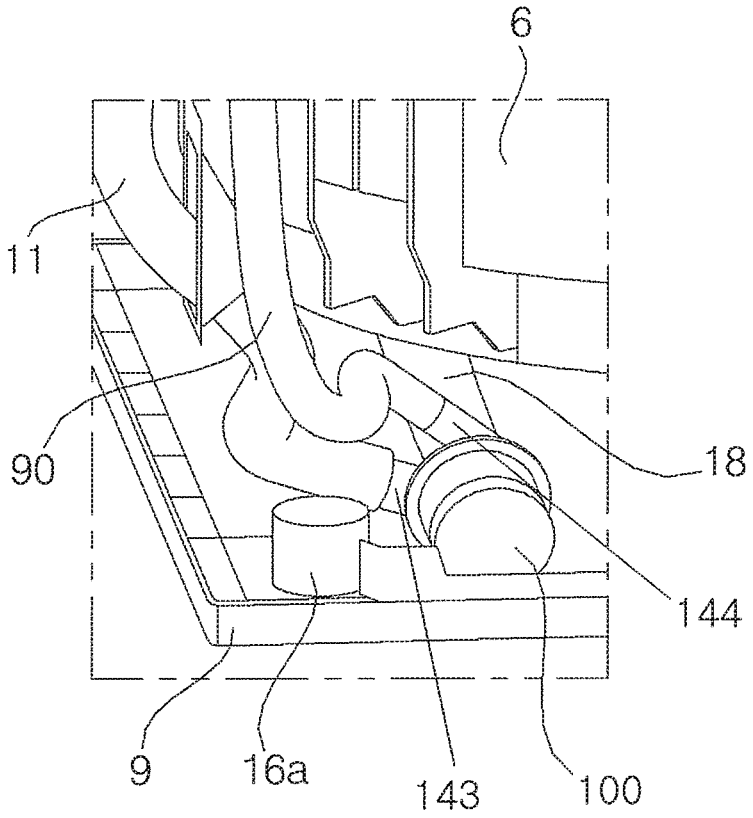
FIGS. 22A and 22B are partial perspective views showing a relation between a lower part of the circulation hose and surrounding elements thereof in FIG. 2.
Figure 22B:
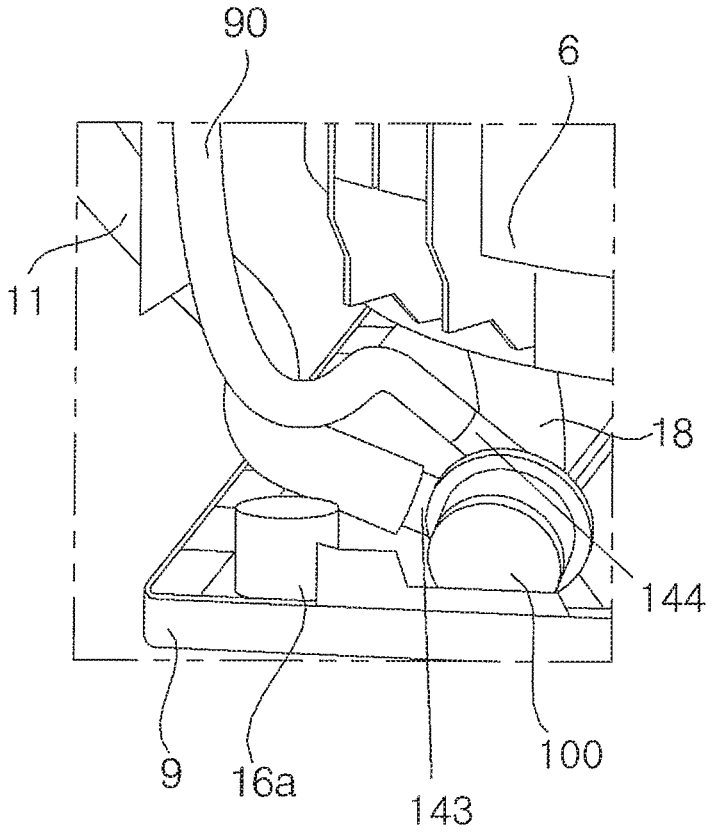
Figure 23:
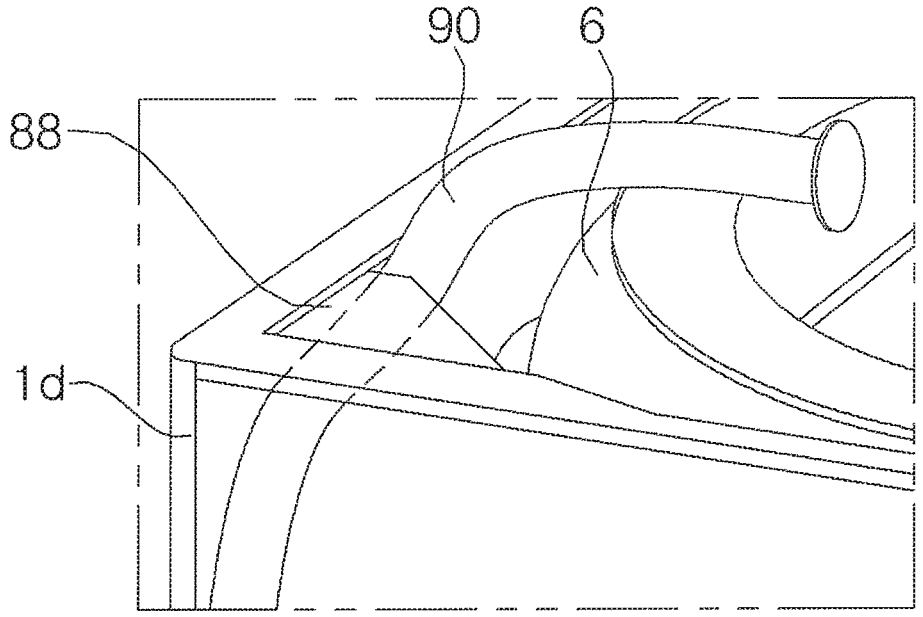
FIG. 23 is a perspective view showing a relation between an upper part of the circulation hose and surrounding elements thereof in FIG. 2.
Figure 24:
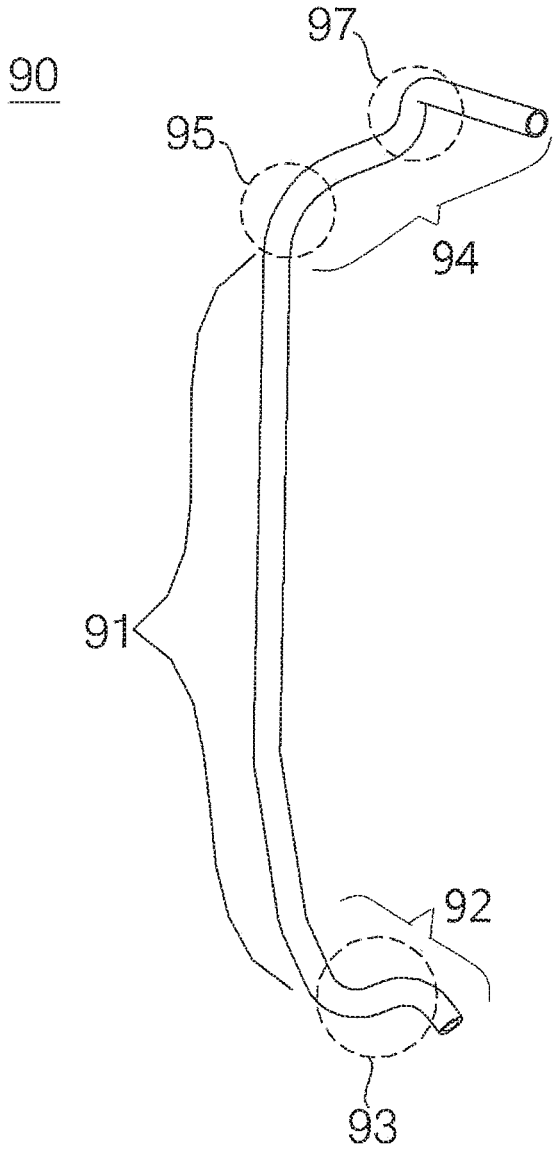
FIG. 24 is a perspective view of the circulation hose of FIG. 2.

Referring to FIG. 21A through 21C, a pump 100*b* according to another embodiment, includes a pump motor of a biaxial motor. Impellers 150*a* and 150*b* may be coupled to both shafts of the biaxial motor. The biaxial motor is a two-shaft motor. The shafts are aligned on the same line and rotated by a common rotator. The pump 100*b* may include the first pump housing 140*a* and the second pump housing 140*b* for receiving the first impeller 150*a* and the second impeller 150*b*, respectively. The first pump housing 140*a* and the second pump housing 140*b* may be coupled to both sides of the pump casing 130.

Supply ports 142*a* and 142*b* may be formed in at least one of the first pump housing 140*a* and the second pump housing 140*b*. In an embodiment, the first supply port 142*a* and the second supply port 142*b* have been illustrated as being formed in the first pump housing 140*a* and the second pump housing 140*b*, respectively, and thus water supplied through the water discharge bellows 18 is supplied to the first supply port 142 and the second supply port 142*b*. However, the present embodiment is not limited to such a configuration. For example, the first pump housing 140*a* and the second pump housing 140*b* may be configured to communicate with each other so that water can be supplied to both the pump housings 140*a* and 140*b* through a single supply port.

The circulation water discharge port 144 may be formed in the first pump housing 140*a*, and the water discharge port 143 may be formed in the second pump housing 140*b*. The present embodiment has substantially the same configuration as the previous embodiment except that the circulation water discharge port 144 and the water discharge port 143 are not formed in a single common pump housing, but are formed in the first pump housing 140*a* and the second pump housing 140*b*. The water discharge port 143 may not be formed in the first pump housing 140*a*, and the circulation water discharge port 144 may not be formed in the second pump housing 140*b*.

When the pump motor is rotated forward, water forcibly sent by the first impeller 150*a* is discharged through the circulation water discharge port 144. On the contrary, when the pump motor is rotated backward, water forcibly sent by the second impeller 150*b* may be discharged through the water discharge port 143.

Referring to FIGS. 22A to 24, the circulation hose 90 may be provided in the cabinet 1. The circulation hose 90 may be provided near the inside corner of the cabinet 1. The circulation hose 90 may be provided near an inside corner that belongs to the inside corners of the cabinet 1 and that is located at the back. The circulation hose 90 may include an upward extension part 91 that is upward extended. Water pumped by the pump 100 flows from the bottom to the top of the upward extension part 91. In the present embodiment, the upward extension part 91 is upward extended up to the lower side of the hanger bracket 88 fixed to the inside of an corner formed by the side part 1*c* and the backside unit 1*d* (refer to FIGS. 2 and 3).

The upward extension part 91 may be located near the corner of the cabinet 1. The pump 100 may be provided on one side under the cabinet 1. In this case, the upward extension part 91 may be provided near an inside corner that belongs to the inside corners of the cabinet 1 and that is located at the back on the one side. Alternatively, the upward extension part 91 may be provided on the same side as the circulation nozzle 12 based on the dispenser 17.

The circulation hose 90 may include a pump connection part 92 for connecting the pump 100 and the bottom of the upward extension part 91 and a nozzle connection part 94 for connecting the top of the upward extension part 91 and the circulation nozzle 12. The shape of the pump connection part 92 is described below based on a flow direction of water. The pump connection part 92 may be formed so that it is backward extended from the pump 100, roundly curved and horizontally extended in any one of both lateral directions, upward roundly curved, and connected to the bottom of the upward extension part 91.

The lateral direction refers to the direction toward any one of the two side parts 1*b* and 1*c*. For example, a portion that belongs to the pump connection part 92 and that is backward extended from the pump 100 may be upward inclined. The pump connection part 92 may be formed in such a way as to be backward extended from the pump 100 so that it forms an upward inclination, roundly curved in the direction of an inside corner that belongs to the inside corners of the cabinet 1 and that is close to the pump connection part 92, substantially horizontally extended, upward curved roundly, and then connected to the bottom of the upward extension part 91.

In an embodiment in which the upward extension part 91 is provided in any one of the inside corners of the cabinet 1, the pump connection part 92 may be formed in such a way as to be backward extended from the pump 100 so that it forms an upward inclination, roundly curved in the direction of an inside corner in which the upward extension part 91 is provided, horizontally extended, upward roundly curved, and then connected to the bottom of the curved the upward extension part 91.

The shape of the nozzle connection part 94 is described below based on a flow direction of water. The nozzle connection part 94 may be formed in such a way as to be roundly curved from the top of the upward extension part 91 in the other one of both directions, horizontally extended, upward extended and roundly curved, forward rounded and curved, and then connected to the circulation nozzle 12. The other one of both directions refers to the remaining one direction different from the direction in which the pump connection part 92 is curved.

The nozzle connection part 94 may be formed in such a way as to be roundly curved from the top of the upward extension part 91 in the direction opposite the direction of an inside corner that belongs to the inside corners of the cabinet 1 and that is close to the nozzle connection part 94, horizontally extended, upward extended and roundly curved, forward rounded and curved, and then connected to the circulation nozzle 12.

In an embodiment in which the upward extension part 91 is provided in any one of the inside corners of the cabinet 1, the upward extension part 91 may be formed in such a way as to be roundly curved in the direction opposite the direction of the inside corner in which the upward extension part 91 is provided, horizontally extended, upward extended and roundly curved, forward rounded and curved, and then connected to the circulation nozzle 12.

The characteristics of the circulation hose 90 are described below based on a provided relation between surrounding elements. The circulation hose 90 may include a first curved part 93 which is connected to the circulation water discharge port 144, at least one roundly curved from the protrusion direction of the circulation water discharge port 144 to the direction of the corner in which the upward extension part 91 is provided, and at least one roundly curved upward from the direction of the corner so that it is connected to the bottom of the upward extension part 91.

The circulation hose 90 may include a second curved part 95 which is connected to the top of the upward extension part 91 and at least one roundly curved in the direction that becomes close to the circulation nozzle 12. The second curved part 95 is roundly curved in the horizontal direction along the inside surface of any one of the front part 1*a*, the two side parts 1*b* and 1*c*, and the backside unit 1*d*, and is extended to become closer to the circulation nozzle 12. The second curved part 95 is roundly curved from the hanger bracket 88 along the backside unit 1*d* in the horizontal direction and then extended up to a portion adjacent to the backside unit 1*d* at the back of the circulation nozzle 12.

The circulation hose 90 may include a third curved part 97 which is at least one roundly curved upward from the downstream side of the second curved part 95, extended up to the height of the circulation nozzle 12, and then at least one roundly curved in the direction of the circulation nozzle 12 so that it is connected to the circulation nozzle 12.

The entire circulation hose 90 may be made of the same material or both end parts 90*a* and 90*c* and a section 90*b* between the two end parts may be made of different materials. In an embodiment, the entire circulation hose 90 may be made of a rubber material, such as ethylenepropylene (EPDM).

Figure 25:
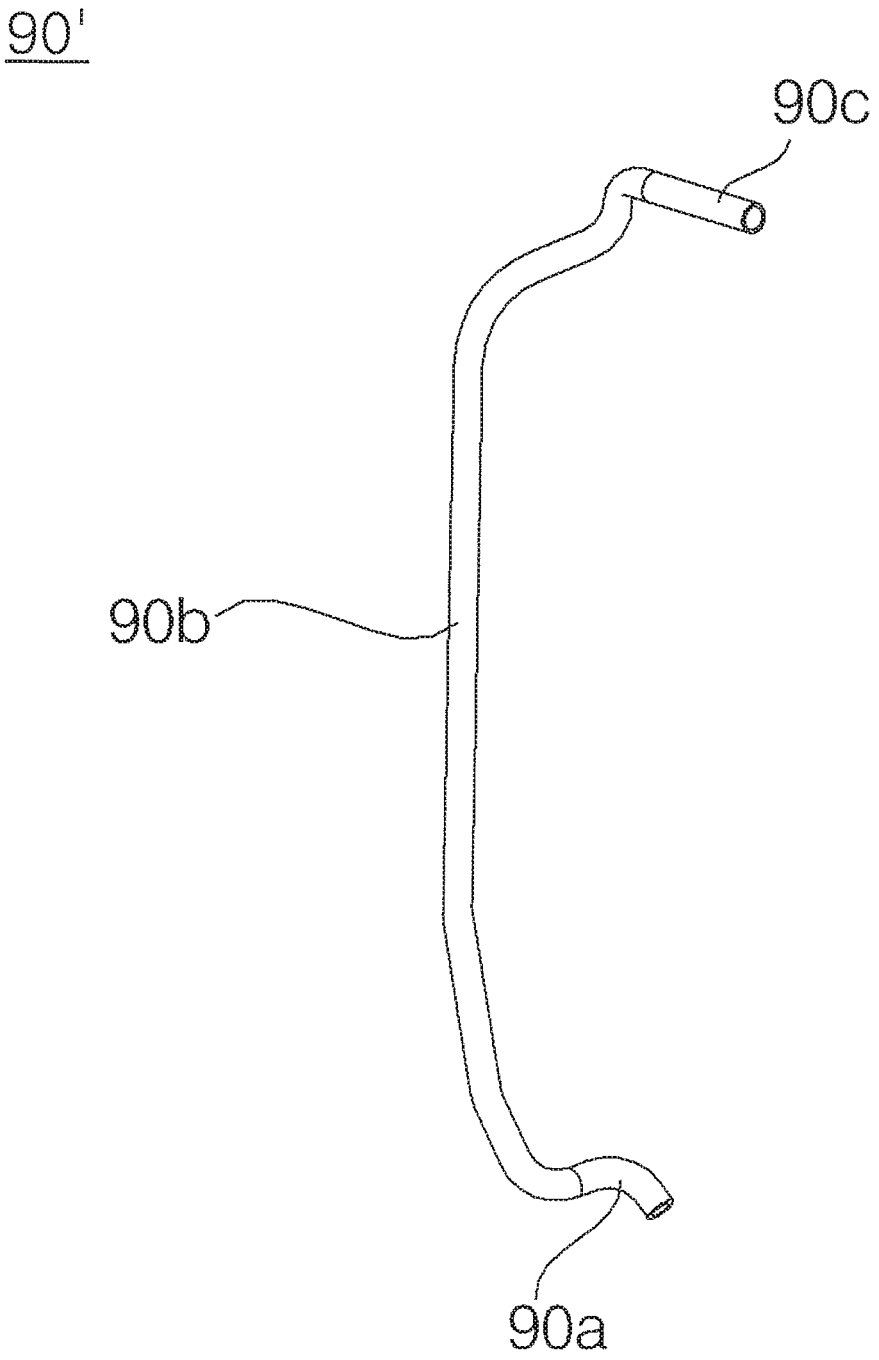
FIG. 25 is a perspective view of a circulation hose according to another embodiment.

Referring to FIG. 25, a circulation hose may include first and second end parts 90*a* and 90*c* and a section 90*b* between the first end part 90*a* and the second end part 90*c*. The first and the second end parts 90*a* and 90*c* may be made of a soft material. The section 90*b* may be made of a material harder than that of the first and the second end parts 90*a* and 90*c*. The first end part 90*a* and/or the second end part 90*c* may be made of a rubber material. The section 90*b* may be made of a material harder than the rubber material, for example, polypropylene (PP).

The section 90*b* is made of a hard material as described above. Accordingly, although water fluctuates through the circulation hose 90' when the pump 100 operates, the section 90*b* is not easily deformed and maintains its location. As a result, a possibility that the section 90*b* may come into contact with the inside surface of the cabinet 1 or the outer tub 6 is poor. The first end part 90*a* and the second end part 90*c* coupled to the pump 100 and the circulation nozzle 12, respectively, are made of a soft material. Accordingly, the vibration of the pump 100 or vibration delivered in a spray process through the circulation nozzle 12 can be less delivered to the section 90*b*.

The hose part of the circulation hose 90 made of the EPDM material may have a pipe or hose thickness of 3 mm, an inside diameter of 18 mm, and an outside diameter of 24 mm. Furthermore, the hose part of the circulation hose 90 made of the PP material may have a pipe or hose thickness of 2.5 mm, an inside diameter of 20 mm, and an outside diameter of 25 mm. In some embodiments, the circulation hose 90 may be attached to the outer tub 6. If the outer tub 6 and the circulation hose 90 are strongly coupled, a danger that a connection between the outer tub 6 and the circulation hose 90 may be broken can be reduced.

In a first embodiment, the upward extension part 91 may be provided to be upward extended while coming into contact with the outer tub 6, and may include a fixing part (not shown) for fixing the upward extension part 91 and the outer tub 6 to a specific location of the outer tub 6. Furthermore, the pump connection part 92 or the first curved part 93 may be attached to the outer tub 6. A fixing part (not shown) for fixing the pump connection part 92 or the first curved part 93 and the outer tub 6 may be provided. Furthermore, the nozzle connection part 94, the second curved part 95 or the third curved part 97 may be attached to the outer tub 6. A fixing part (not shown) for fixing the nozzle connection part 94, the second curved part 95 or the third curved part 97 and the outer tub 6 may be provided.

In a second embodiment, the circulation hose 90 may be provided to be spaced apart from the outer tub 6. When the inner tub 5 is rotated, the outer tub 6 is vibrated, and a surface of the vibrated outer tub 6 does not come into contact with a surface of the circulation hose 90. Accordingly, a danger that the circulation hose 90 may be broken can be reduced, and noise attributable to a touch can be reduced.

In the second embodiment, the washing machine may include a first fixing part 71 spaced apart from the top of the base 9 upward at an interval of 280 mm and provided on the inside surface of the backside unit 1*d*. The first fixing part 71 may fix the upward extension part 91 to the backside unit 1*d* or the side parts 1*b* and 1*c*. The washing machine may include a second fixing part 72 spaced apart from the first fixing part 71 upward at an interval of 260 mm and provided on the inside surface of the backside unit 1*d*. The second fixing part 72 may fix the upward extension part 91 to the backside unit 1*d* or the side parts 1*b* and 1*c*. Accordingly, a load of the upward extension part 91 can be equally distributed, and the upward extension part 91 is fixed to the cabinet 1. In the present description, 280 mm and 260 mm are meant to include a tolerance permitted to a person having ordinary skill in the art.

In the second embodiment, the washing machine may include a third fixing part 73 provided on the inside surface of the top cover 2*a* and configured to fix the circulation hose 90 to the top cover 2*a* on the downstream side of the third curved part 97. Accordingly, weight of the circulation hose 90 is supported even on the upper side, and the circulation hose 90 can be spaced apart from the upper side of the outer tub 6.

The washing machine according to an embodiment may effectively dampen laundry exposed to air within the inner tub because a spray angle of the circulation nozzle can be changed. Furthermore, there is an advantage in that a washing variation according to a laundry amount may be reduced because a spray angle of the circulation nozzle is changed based on a laundry amount during washing.

There are advantages in that the amount of water used for washing can be reduced and laundry can be uniformly dampened and a change of color generated because laundry is exposed to air or a secondary contamination attributable to the congelation of detergent dregs can be prevented because water can be supplied to laundry exposed to air using the circulation nozzle.

Figure 26:
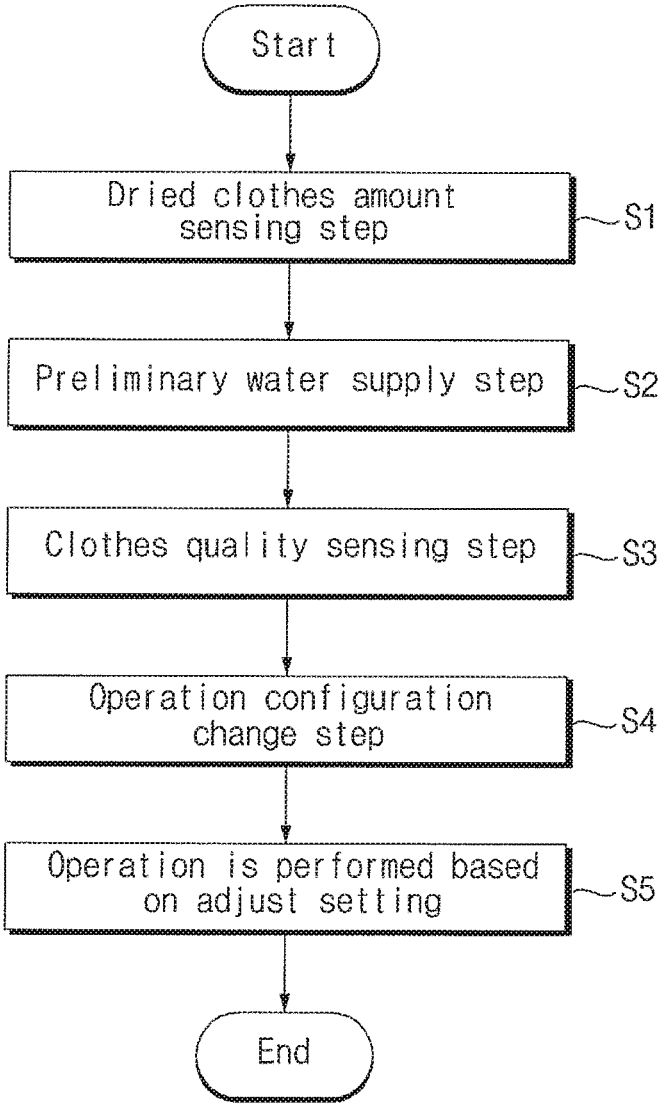
FIG. 26 is a flowchart illustrating a method for controlling a washing machine according to an embodiment.

A method for controlling a washing machine according to an embodiment may be described below with reference to FIGS. 26 and 28. Referring to FIG. 4, the memory 47 may store water supply time ranges and water level change ranges in which the quality of laundry or clothes, or a "laundry quality" or "clothes quality", is divided based on a moisture content ratio and which have been set in response to a laundry quality. For example, Table 1 shows water supply time ranges, based on water supply times in a preliminary water supply step, and water level change ranges if a laundry quality is divided into low moisture-containing laundry, middle moisture-containing laundry, and high moisture-containing laundry. A method for determining a laundry quality using the water supply time ranges and the water level change ranges may be described later.

TABLE 1

| CLOTHES QUALITY | PRELIMINARY WATER SUPPLY TIME RANGE (t1 < t2 < t3) | WATER LEVEL CHANGE RANGE (w1 < w2 < w3) |
|---|---|---|
| LOW MOISTURE-CONTAINING LAUNDRY | [t1, t2] | [w1, w2] |
| MIDDLE MOISTURE-CONTAINING | [t2, t3] | [w2, w3] |

TABLE 1-continued

| CLOTHES QUALITY | PRELIMINARY WATER SUPPLY TIME RANGE (t1 < t2 < t3) | WATER LEVEL CHANGE RANGE (w1 < w2 < w3) |
|---|---|---|
| LAUNDRY HIGH MOISTURE-CONTAINING LAUNDRY | [t3, t4] | [w3, w4] |

In addition, the memory 47 may store a washing operation algorithm and various settings for a washing operation. The washing operation may be defined as an operation from the start of an operation of the washing machine to the end of the operation of the washing machine in accordance with a configuration through the input unit 46, and may include a washing cycle, a rinsing cycle and/or a dehydration cycle.

Configurations for the washing operation may include a preliminary water supply time, a pump operation time, the operation pattern and operation speed of the washing motor, a water discharge time, and a dehydration time, which may have been set based on a laundry amount.

The control unit or controller 30 may be an operation device electrically connected to electronic parts that form the washing machine and configured to participate in an overall operation of the electronic parts, and may be implemented using a central processing unit (CPU) for interpreting a command and executing arithmetic logic operation or data processing.

The operation setting module 31 may set a washing operation in response to setting inputted through the input unit 46. For example, when a specific washing course is selected through the input unit 46, the operation setting module 31 may perform setting so that a washing operation corresponding to the specific washing course is performed and may configure various settings required to perform the washing operation.

The laundry amount determination module 32 may determine the amount of laundry contained in the inner tub 5. Inertia of the inner tub 5 or the pulsator 15 may become an index for determining a laundry amount. For example, when the inner tub 5 in a stop state is rotated, more time is taken for the inner tub 5 to reach a predetermined target speed because stop inertia of the inner tub 5 is great according to an increase of a laundry amount. Accordingly, the laundry amount determination module 32 may determine a laundry amount based on the time taken for the inner tub 5 to reach a target speed.

For another example, when the inner tub 5 that is being rotated is braked, the laundry amount determination module 32 may determine a laundry amount based on the time taken for the inner tub 5 to stop. In this case, rotation inertia of the inner tub 5 that varies according to the laundry amount is used. In addition, the laundry amount may be determined by further taking into consideration a change of an input or output current, electromotive force, etc. of the washing motor 41. A method for calculating a laundry amount is widely known in the art and thus a detailed description thereof has been omitted, but the laundry amount determination module 32 may determine a laundry amount using various known methods.

Figure 27:
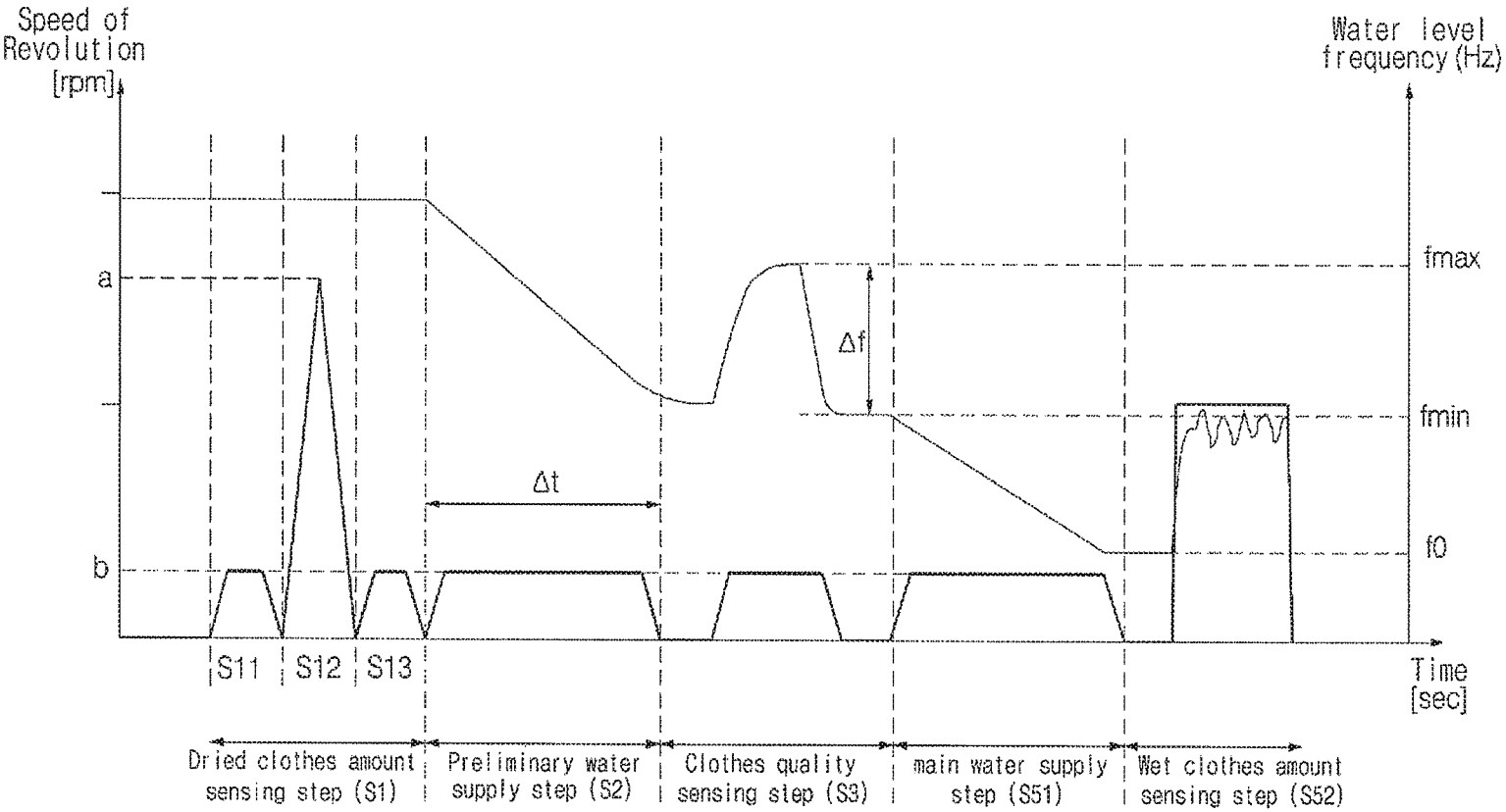
FIG. 27 shows speeds of a washing motor and water level frequencies while a washing machine is controlled using the control method of FIG. 26.

A dried laundry amount sensing step S1 and a wet laundry amount sensing step S52 shown in FIG. 27 are steps of sensing a laundry amount. The dried laundry amount sensing step S1 may be performed before a preliminary water supply step S2 is performed, and the wet laundry amount sensing step S52 may be performed after an main water supply step S51 is performed. The dried laundry amount sensing step S1 is performed in the state in which laundry have not been soaked with water. The wet laundry amount sensing step S52 is performed in the state in which laundry have been soaked with water. Hereinafter, a laundry amount determined in the dried laundry amount sensing step S1 is called a "dried laundry amount" or "dried clothes amount", and a laundry amount determined in the wet laundry amount sensing step S52 is called a "wet laundry amount."

The dried laundry amount sensing step S1 may include a first driving step S11 in which the inner tub 5 is accelerated up to a first speed of revolution "b" [rpm] from a stop state, rotated at the first rotation speed for a specific time, and then stopped, a second driving step S12 in which the inner tub 5 is accelerated up to a second speed of revolution "a" [rpm], braked, and stopped, a third driving step S13 in which the inner tub 5 is driven in the same manner as that of step S11. The first rotation speed is about 30 rpm. At this speed, a centrifugal force of a degree by which laundry may adhere to the inside surface of the inner tub 5 is not generated. The second rotation speed is a speed at which laundry together with the inner tub 5 may be rotated in the state in which the laundry have adhered to the inside surface of the inner tub 5 by a centrifugal force generated by the rotation of the inner tub 5. The second rotation speed may be determined to be about 100 rpm or higher.

The laundry amount determination module 32 may primarily calculate a dried laundry amount in the first driving step S11 may calculate the parameters (e.g., a counter electromotive force and a d-axis input current) of the washing motor 41 while the second driving step S12 is performed, and may calculate a dried laundry amount again in the third driving step S13. In this case, the dried laundry amount may be more accurately determined by correcting it using the dried laundry amount calculated in the first driving step S11 and the parameters calculated in the second driving step S12.

In the preliminary water supply step S2, water is supplied to the inner tub 5 until a water level in the outer tub 6 reaches a predetermined preliminary water supply level. The preliminary water supply step S2 may be performed through the dispenser 17. The operation control module 35 may open at least one water supply valve 43 so that water is supplied. When a water level sensed by the water level sensor 42 reaches the preliminary water supply level, the operation control module 35 may shut the water supply valve 43. The second water supply valve 43 may be open, so hot water may be supplied to the detergent reception unit 172*a*. At this time, in the preliminary water supply step S2, a detergent is supplied along with the hot water. Accordingly, there is an advantage in that a cleaning power is improved because the detergent of a high concentration activated by the hot water acts on the laundry in the inner tub 5.

The preliminary water supply level is a water level at which water can be circulated through the circulation nozzle 12. The preliminary water supply level is set in accordance with the amount of water which may continue to be delivered from the outer tub 6 to the circulation nozzle 12 while the pump 100, 100*a*, 100*b* operates at a predetermined rotation speed.

The water level sensor 42 may output a frequency, that is, an electrical signal according to air pressure that acts on the inside of a pipe communicating with the outer tub 6 (hereinafter referred to as a "water level frequency"). A water level in the outer tub 6 is incorporated into the water level frequency because air pressure within the pipe varies depending on the water level of the outer tub 6. The water level sensor 42 may be configured to output a higher water level frequency as a water level within the outer tub 6 rises. The water level frequency is gradually decreased as the preliminary water supply step S2 proceeds (refer to FIG. 27).

After the supply of water is started, a time Δt, or a "preliminary water supply time", taken for a water level within the outer tub 6 to reach the preliminary water supply level may be measured. A timer for measuring a water supply time may be provided. In general, the control unit 30 may measure time based on a CPU clock. The timer may be implemented using the control unit 30.

A laundry quality according to a moisture content may be determined based on a preliminary water supply time. That is, if laundry are made of a material capable of absorbing a lot of water, for example, high moisture-containing laundry, a large amount of water is absorbed by the laundry while water is supplied. Accordingly, a preliminary water supply time is increased, and the preliminary water supply time is decreased in order of middle moisture-containing laundry and low moisture-containing laundry. That is, the laundry quality determination module 33 may determine a laundry quality based on a preliminary water supply time because the preliminary water supply time has a correlation relation with a ratio of a moisture content of laundry.

The laundry quality determination module 33 may determine a laundry quality by comparing the preliminary water supply time with a preliminary water supply time range (refer to Table 1) stored in the memory 47. That is, the laundry quality may be determined to low moisture-containing laundry, middle moisture-containing laundry or high moisture-containing laundry based on a laundry quality corresponding to a preliminary water supply time range to which the preliminary water supply time belongs.

If a laundry quality is determined by taking only the preliminary water supply time into consideration as described above, however, there is a problem in that inaccurate results may be derived in the case of a specific laundry quality. For example, in the case of laundry that form a fabric membrane within the inner tub 5, a preliminary water supply time belongs to the preliminary water supply time range [t3, t4] corresponding to high moisture-containing laundry, but the materials of the laundry may be middle moisture-containing laundry. For example, laundry, such as a bed cover, forms a membrane within the inner tub 5, and thus some of supplied water is contained in a depressed space formed by the membrane. As a result, a preliminary water supply time becomes longer than the upper limit "t3" of a water supply time range corresponding to middle moisture-containing laundry.

For another example, in the case of water-repellent functional laundry, such as mountain clothes or bedclothing for mountain climbing, the laundry correspond to low moisture-containing laundry, but form a fabric membrane within the inner tub 5. Accordingly, a preliminary water supply time may belong to the preliminary water supply time range [t2, t3] corresponding to middle moisture-containing laundry.

Accordingly, as described above, a difference between an actual laundry quality and a laundry quality determined based on a preliminary water supply time needs to be corrected. For this reason, in the laundry quality sensing step S3, while water is sprayed into the inner tub 5 using the circulation nozzle 12, a water level change is sensed. The laundry quality determination module 33 corrects a laundry quality using the water level change sensed as described above.

The laundry quality sensing step S3 is performed after the preliminary water supply step S2 is completed. The pump 100, 100*a*, 100*b* is driven under the control of the operation control module 35, and thus water is sprayed into the inner tub 5 through the circulation nozzle 12. Furthermore, while water is sprayed as described above, the water level sensor 42 senses a water level. The water level in the outer tub 6 gradually decreases but the water level frequency increases as the pump 100, 100*a*, 100*b* is driven, but increases as the sprayed water is discharged from the inner tub 5 to the outer tub 6 and finally converges on a specific range. The laundry quality determination module 33 may determine the laundry quality by further taking into consideration a water level change Δw along with the preliminary water supply time Δt. A water level frequency change Δf corresponds to the water level change Δw. Accordingly, the laundry quality determination module 33 may determine the laundry quality directly using the water level frequency change Δf or using the water level change Δw determined based on the water level frequency change Δf. The water level frequency change Δf is only an example for calculating the water level change Δw. A method for calculating the water level change Δf may be performed in various ways depending on output, or a value output in response to a water level, of the water level sensor 42.

If a sensed preliminary water supply time Δt is not greater than the upper limit "t3" of the preliminary water supply time range (e.g., [t2, t3]) corresponding to a laundry quality (e.g., the middle moisture-containing laundry) having a ratio of a moisture content one level lower than a laundry quality (e.g., the high moisture-containing laundry) selected based on the preliminary water supply time Δt by a predetermined reference value "ts1", the laundry quality determination module 33 may calculate the water level change Δw. If the water level change Δw is lower than the lower limit "w3" of the water level change range [w3, w4] corresponding to a laundry quality (e.g., the high moisture-containing laundry) selected based on the preliminary water supply time Δt, the laundry quality determination module 33 may determine a corresponding laundry quality to be a laundry quality (e.g., the middle moisture-containing laundry) having a ratio of a moisture content one level lower than the laundry quality (e.g., the high moisture-containing laundry) selected based on the preliminary water supply time Δt. In other cases, the laundry quality selected based on the preliminary water supply time Δt may become a final laundry quality without any change.

Figure 28:
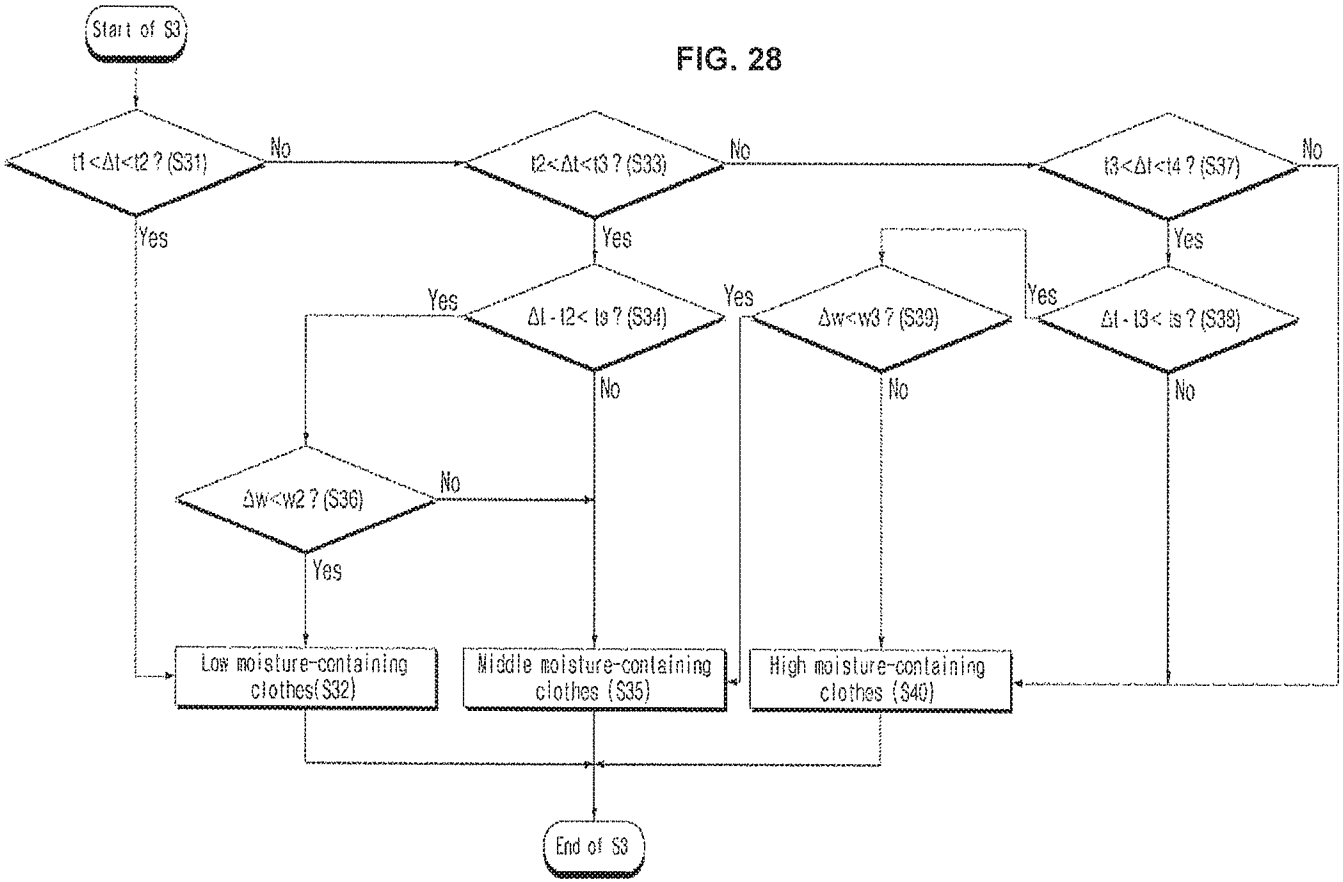
FIG. 28 is a flowchart illustrating a method for determining a laundry quality.

FIG. 28 shows an algorithm for determining a laundry quality in the laundry quality sensing step S3 in detail. FIG. 28 shows an example in which a laundry quality is divided into low moisture-containing laundry, middle moisture-containing laundry, and high moisture-containing laundry. If a sensed preliminary water supply time Δt belongs to the first preliminary water supply time range [t1, t2] corresponding to the low moisture-containing laundry (S31), the laundry quality determination module 33 may determine a laundry quality to be the low moisture-containing laundry.

If, as a result of the determination in step S31, it is determined that the sensed preliminary water supply time Δt does not belong to the first preliminary water supply time range [t1, t2], the laundry quality determination module 33 may determine whether the sensed preliminary water supply time Δt belongs to the second preliminary water supply time range [t2, t3] corresponding to the middle moisture-containing laundry (S33). If, as a result of the determination in step S33, it is determined that the sensed preliminary water supply time Δt belongs to the second preliminary water supply time range [t2, t3], the laundry quality determination module 33 may compare a difference between the sensed preliminary water supply time Δt and the lower limit "t2" of the second preliminary water supply time range with the reference value "ts1" (S34).

If, as a result of the comparison in step S34, a difference between the sensed preliminary water supply time Δt and the lower limit "t2" is found to be smaller than the reference value "ts1", the laundry quality determination module 33 may compare the water level change Δw with the lower limit "w2" of the second water level change range [w2, w3] corresponding to the middle moisture-containing laundry (S36). If, as a result of the comparison in step S36, the water level change Δw is found to be smaller than the lower limit "w2", the laundry quality determination module 33 may determine the laundry quality to be the low moisture-containing laundry (S32). On the contrary, if, as a result of the comparison in step S36, the water level change Δw is found to be equal to or greater than the lower limit "w2", the laundry quality determination module 33 may determine the laundry quality to be the middle moisture-containing laundry (S35).

If, as a result of the determination in step S33, it is determined that the sensed preliminary water supply time Δt does not belong to the second preliminary water supply time range [t2, t3], the laundry quality determination module 33 may determine whether the preliminary water supply time Δt belongs to the third water level change range [w3, w4] corresponding to the high moisture-containing laundry (S37). If, as a result of the determination in step S37, it is determined that the preliminary water supply time Δt belongs to the third water level change range [w3, w4], the laundry amount determination module 33 may compare a difference between the preliminary water supply time Δt and the lower limit "t3" of the third preliminary water supply time range with the reference value "ts" (S38).

If, as a result of the comparison in step S38, the difference Δt−t3 is found to be smaller than the reference value "ts", the laundry amount determination module 33 may compare the water level change Δw with the lower limit "w3" of the third water level change range [w3, w4] (S39). If, as a result of the comparison in step S39, the water level change Δw is found to be smaller than the lower limit "w3", the laundry quality determination module 33 may determine the laundry quality to be the middle moisture-containing laundry (S35). If, as a result of the comparison in step S39, the water level change Δw is found to be equal to or greater than the lower limit "w3", the laundry quality determination module 33 may determine the laundry quality to be the high moisture-containing laundry (S40).

If, as a result of the comparison in step S38, the difference Δt−t3 is found to be equal to or greater than the reference value "ts", the laundry amount determination module 33 may determine the laundry quality to be the high moisture-containing laundry.

Water sprayed through the circulation nozzle 12 can uniformly dampen laundry because it can reach a wider area compared to a case where water is supplied through the dispenser 17. Furthermore, the amount of water contained in a fabric membrane can be reduced because moisture stuck to a surface of laundry is detached by spray water pressure. As a result, it may be considered that an influence attributable to a fabric membrane has been a little more excluded from the water level change Δw calculated in this process. Accordingly, if a difference between the preliminary water supply time Δt and the upper limit "t3" of the preliminary water supply time range (e.g., [t2, t3]) corresponding to a laundry quality, such as middle moisture-containing laundry, having a ratio of a moisture content one level lower than a laundry quality, such as high moisture-containing laundry, selected based on the preliminary water supply time Δt is relatively small, there may be an error in determining a laundry quality attributable to the fabric membrane. Accordingly, a laundry quality is determined by also taking the water level change Δw into consideration.

As shown in FIG. 27, in the laundry quality sensing step S3, the operation control module 35 may control the inner tub 5 so that it is rotated at the first speed of revolution "b" [rpm] while water is sprayed through the circulation nozzle 12. A phenomenon in which water is confined in a specific part of laundry can be reduced because water sprayed through the circulation nozzle 12 can reach the laundry more uniformly.

In an operation configuration change step S4, the setting of the washing operation is controlled based on the laundry quality sensed in the laundry quality sensing step S3. The configuration control module 34 may adjust the setting of a washing operation based on a laundry quality by controlling the laundry quality determination module 33. The configuration control module 34 may adjust settings, such as, e.g., an main water supply level MW, a washing intensity WS, a dehydration time ST, and a water discharge time DT, set by the operation setting module 31.

In the case where a laundry quality is divided into low moisture-containing laundry, middle moisture-containing laundry, and high moisture-containing laundry as in the embodiment, if a laundry quality determined by the laundry quality determination module 33 corresponds to the middle moisture-containing laundry (i.e., a reference ratio of a moisture content), an main water supply level MW, a washing intensity WS, a dehydration time ST, and a water discharge time DT set by the operation setting module 31 may be maintained without any change.

If a laundry quality determined by the laundry quality determination module 33 corresponds to the low moisture-containing laundry (i.e., lower than the reference ratio of a moisture content), an main water supply level MW may be lowered, a washing intensity WS may become weak, and a dehydration time ST and a water discharge time DT may be decreased.

If a laundry quality determined by the laundry quality determination module 33 corresponds to the high moisture-containing laundry (i.e., higher than the reference ratio of a moisture content), an main water supply level MW may rise, a washing intensity WS may become strong, and a dehydration time ST and a water discharge time DT may be increased.

The washing intensity WS may vary depending on the rotation time, rotation speed, and driving torque of the inner tub 5 or the pulsator 15. An increase of the rotation time, rotation speed and/or driving torque may strengthen the washing intensity WS. A reduction of the rotation time, rotation speed and/or driving torque may weaken the washing intensity WS.

In step S5, the washing operation is performed based on setting adjusted in step S4. The operation control module 35 may control elements of the washing machine based on the adjusted setting. That is, the operation control module 35 may control the operations of the water supply valve 43, the washing motor 41, the water discharge valve 44, and the pump 100, 100*a*, 100*b* based on the adjusted main water supply level MW, washing intensity WS, dehydration time ST, and water discharge time DT. The washing operation may include an main water supply step S51. In the main water supply step S51, water may be supplied through the dispenser 17 and/or the direct water nozzle 13.

If the laundry quality determined in the laundry quality sensing step S3 corresponds to the high moisture-containing laundry, the main water supply level MW is increased by the configuration control module 34. The operation control module 35 may close the water supply valve 43 when a water level sensed by the water level sensor 42 reaches the increased main water supply level MW+ΔMW.

In contrast, if the laundry quality determined in the laundry quality sensing step S3 corresponds to the low moisture-containing laundry, the main water supply level MW may be decreased by the configuration control module 34. The operation control module 35 may close the water supply valve 43 when a water level sensed by the water level sensor 42 reaches the main water supply level MW-ΔMW.

The wet laundry amount sensing step S52 may be performed after water is actually supplied. The wet laundry amount sensing step S52 is different from the dried laundry amount sensing step S1 in that the pulsator 15 is rotated in the state in which the inner tub 5 has been stopped, but has substantially the same process of calculating a laundry amount as the dried laundry amount sensing step S1.

The configuration control module 34 may adjust the setting of the washing operation by further taking into consideration the laundry amount sensed in the wet laundry amount sensing step S52. The operation control module 35 may perform the remaining washing operation based on the setting adjusted as described above.

Figure 29:
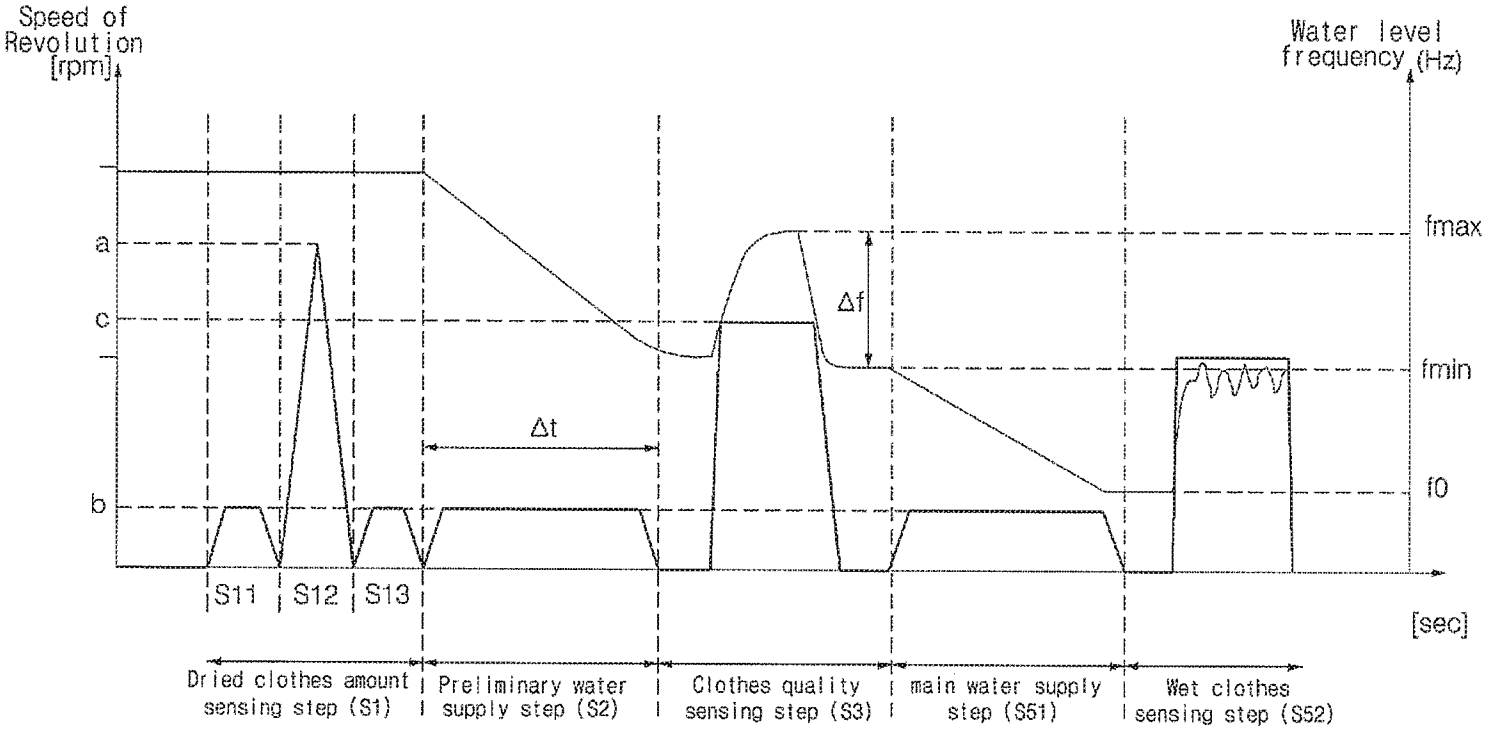
FIG. 29 shows speeds of a washing motor and water level frequencies while a washing machine is controlled using the control method of FIG. 26 according to another embodiment.
Figure 30:
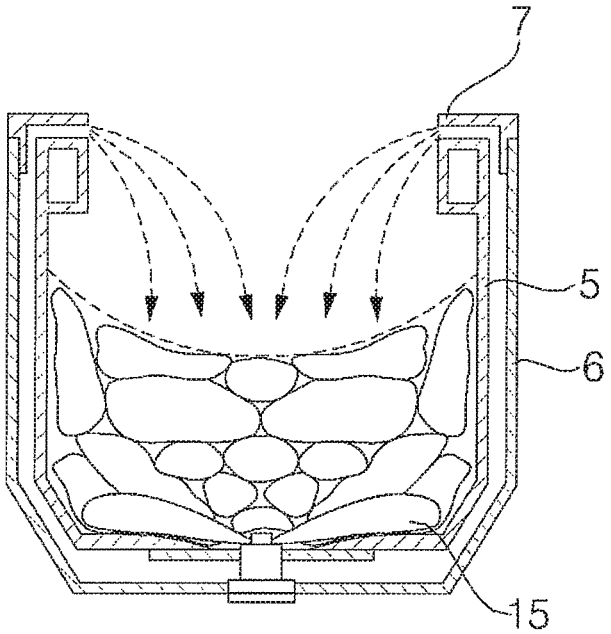
FIG. 30 is a diagram showing a circulation water current formed by rotation of an inner tub.

Referring to FIGS. 29 and 30, the method for controlling a washing machine may be the same as the method according to the aforementioned embodiments except that water is not sprayed through the circulation nozzle 12 while a water level change ΔW is sensed, but a circulation water current, such as that of FIG. 30, is formed by the rotation of the inner tub 5.

That is, the inner tub 5 is rotated at a predetermined speed "c" [rpm]. Accordingly, water rises higher than the top of the inner tub 5 between the inner tub 5 and the outer tub 6 by a centrifugal force and forms a circulation water current that falls to the inner tub 5. In such a process, a water level change Δw is calculated based on a value sensed by the water level sensor 42. The water level change Δw calculated as described above may be used to determine a laundry quality in accordance with the method described with reference to FIGS. 26 to 28.

First, the washing machine and the method for controlling a washing machine according to according to an embodiment of the present disclosure have an advantage in that a laundry quality according to a ratio of a moisture content can be determined accurately.

Second, there is an advantage in that a laundry quality can be determined more accurately by further taking into consideration a case where a fabric membrane is formed.

Third, there are advantages in that washing performance can be improved, consumed power and water can be adjusted, and the time taken for a washing operation can be optimized by adjusting the settings of a washing operation based on a laundry quality.

Fourth, there is an advantage in that the accuracy of a determination of a laundry quality can be improved using a water level change sensed in a process of spraying water through a circulation nozzle in a washing machine having a structure in which water discharged from an outer tub is sprayed into an inner tub through the circulation nozzle.

Fifth, there are advantages in that the accuracy of a determination of a laundry quality can be improved using a water level change sensed in a process of forming a water current that circulates between the inner tub and the outer tub by the rotation of the inner tub in a washing machine not having a circulation nozzle.

According to embodiments disclosed herein, a washing machine and a method for controlling the washing machine may be capable of accurately determining a laundry quality according to a moisture content ratio. A washing machine and a method for controlling the washing machine may be capable of determining a laundry quality more accurately by taking into consideration a case where a fabric membrane is formed. A washing machine and a method for controlling the washing machine may be capable of controlling the settings of a washing operation based on a laundry quality. A washing machine and a method for controlling the washing machine may be capable of determining a laundry quality based on a water level change sensed in a process of spraying water through a circulation nozzle in a washing machine having a structure in which water discharged from an outer tub is sprayed into an inner tub through a circulation nozzle. A washing machine and a method for controlling the washing machine may be capable of forcibly circulating water between an inner tub and an outer tub by rotating the inner tub and determining a laundry quality based on a water level change sensed in this process.

According to embodiments disclosed herein, in a method for controlling a washing machine including an outer tub, an inner tub to receive laundry, the inner tub provided in the outer tub and being rotatable about a substantially vertical axis, a pulsator rotatably provided in the inner tub, and a pump to pump water from the outer tub to a circulation nozzle that sprays the water into the inner tub, the method comprising sensing an amount of laundry in the inner tub, configuring an operation setting based on the amount of the laundry sensed, supplying water into the inner tub and obtaining a preliminary water supply time taken for a water level within the outer tub to reach a predetermined preliminary water supply level, spraying the water from the outer tub into the inner tub through the circulation nozzle by driving the pump and obtaining a change of water level within the outer tub as the water is sprayed through the circulation nozzle, adjusting the operation setting based on the preliminary water supply time obtained and the change of water level obtained, and performing a washing operation based on the adjusted operation setting.

According to embodiments disclosed herein, in a method for controlling a washing machine including an outer tub configured to have water received in the outer tub, an inner tub configured to receive laundry and to rotate around a vertical axis within the outer tub, a pulsator rotatably provided in the inner tub, and a pump configured to forcibly send water to a circulation nozzle for spraying water discharged from the outer tub to the inner tub, the method includes the steps of (a) sensing the amount of laundry in the inner tub, (b) configuring the setting of a washing operation based on the amount of the laundry sensed in the step (a), (c) supplying water to the inner tub and calculating a preliminary water supply time taken for a water level within the outer tub to reach a predetermined preliminary water supply level, (d) spraying the water discharged from the outer tub into the inner tub through the circulation nozzle by driving the pump and calculating a water level change within the outer tub while the water is sprayed through the circulation nozzle, (e) adjusting the setting of the washing operation based on the preliminary water supply time calculated in the step (c) and the water level change calculated in the step (d), and (f) performing a washing operation based on the adjusted setting.

According to embodiments disclosed herein, in a method for controlling a washing machine including an outer tub configured to have water received in the outer tub, an inner tub configured to receive laundry and to rotate around a vertical axis within the outer tub, a pulsator rotatably provided in the inner tub, and a pump configured to forcibly send water to a circulation nozzle for spraying water discharged from the outer tub to the inner tub, the method includes the steps of (a) sensing the amount of laundry in the inner tub, (b) configuring the setting of a washing operation based on the amount of the laundry sensed in the step (a), (c) supplying water to the inner tub and calculating a preliminary water supply time taken for a water level within the outer tub to reach a predetermined preliminary water supply level, (d) spraying the water discharged from the outer tub into the inner tub through the circulation nozzle by driving the pump and calculating a water level change within the outer tub while the water is sprayed through the circulation nozzle, (e) selecting a first preliminary water supply time range which belongs to preliminary water supply time ranges previously set in accordance with materials of laundry classified based on ratios of a moisture content and to which the preliminary water supply time calculated in the step (c) belongs, (f) determining a material of laundry corresponding to the first preliminary water supply time range to be a material of actual laundry thrown into a drum if the preliminary water supply time calculated in the step (c) is greater than the upper limit of a second preliminary water supply time range one level lower than the selected first preliminary water supply time range by a predetermined reference value or more and determining the material of the actual laundry further based on the water level change calculated in the step (d) if the preliminary water supply time calculated in the step (c) is greater than the upper limit of the second preliminary water supply time range by less than the reference value, (g) adjusting the setting of the washing operation based on the material of the actual laundry determined in the step (f), and (h) performing a washing operation in accordance with the adjusted setting.

According to embodiments disclosed herein, in a method for controlling a washing machine including an outer tub configured to have water received in the outer tub, an inner tub configured to receive laundry and to rotate around a vertical axis within the outer tub, a pulsator rotatably provided in the inner tub, and a pump configured to forcibly send water to a circulation nozzle for spraying water discharged from the outer tub to the inner tub, the method includes the steps of (a) sensing the amount of laundry in the inner tub, (b) configuring the setting of a washing operation based on the amount of the laundry sensed in the step (a), (c) supplying water to the inner tub and calculating a preliminary water supply time taken for a water level within the outer tub to reach a predetermined preliminary water supply level, (d) spraying the water discharged from the outer tub into the inner tub through the circulation nozzle by driving the pump and calculating a water level change within the outer tub while the water is sprayed through the circulation nozzle, (e) selecting a first preliminary water supply time range which belongs to preliminary water supply time ranges previously set in accordance with materials of laundry classified based on ratios of a moisture content and to which the preliminary water supply time calculated in the step (c) belongs, (f) determining a material of laundry corresponding to the first preliminary water supply time range to be a material of actual laundry thrown into a drum if the preliminary water supply time calculated in the step (c) is greater than the upper limit of a second preliminary water supply time range one level lower than the selected first preliminary water supply time range by a predetermined reference value or more and determining the material of the actual laundry further based on the water level change calculated in the step (d) if the preliminary water supply time calculated in the step (c) is greater than the upper limit of the second preliminary water supply time range by less than the reference value, (g) adjusting the setting of the washing operation based on the material of the actual laundry determined in the step (f), and (h) performing a washing operation in accordance with the adjusted setting.

A washing machine according to an embodiment may include an outer tub configured to have water received in the outer tube, at least one water supply valve configured to supply water to the outer tub, an inner tub configured to receive laundry and to rotate around a vertical axis within the outer tub, a pulsator rotatably provided in the inner tub, a circulation nozzle configured to spray water into the inner tub, a pump configured to pump water discharged from the outer tub, a circulation hose configured to guide the water pumped by the pump into the circulation nozzle, a laundry amount determination module configured to determine the amount of laundry within the inner tub, an operation setting module configured to form the setting of a washing operation based on the laundry amount determined by the laundry amount determination module, a timer configured to calculate a time when water is supplied to the outer tub through the water supply valve, a water level sensor configured to sense a water level within the outer tub, an operation control module configured to close the water supply valve when the water level sensed by the water level sensor reaches a predetermined preliminary water supply level after opening the water supply valve and to control the pump so that the pump is driven, and a laundry quality determination module configured to determine a laundry quality based on a preliminary water supply time calculated by the timer and taken for the water level within the outer tub to reach the preliminary water supply level and a water level change within the outer tub sensed by the water level sensor while the pump is driven.

This application relates to U.S. application Ser. No. 15/283,488, Ser. No. 15/283,527, Ser. No. 15/283,571, Ser. No. 15/283,662, and Ser. No. 15/283,763, all filed on Oct. 3, 2016, which are hereby incorporated by reference in their entirety. Further, one of ordinary skill in the art will recognize that features disclosed in these above-noted applications may be combined in any combination with features disclosed herein.

Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A method for controlling a washing machine including an outer tub, an inner tub to receive laundry, the inner tub provided in the outer tub and being rotatable about a substantially vertical axis, a pulsator rotatably provided in the inner tub, and a pump to pump water from the outer tub to a circulation nozzle that sprays the water into the inner tub, the method comprising:

sensing an amount of laundry in the inner tub;

configuring an operation setting based on the amount of the laundry sensed;

supplying water into the inner tub and obtaining a preliminary water supply time taken for a water level within the outer tub to reach a preliminary water supply level predetermined according to the sensed amount of laundry;

stopping the supplying of the water into the inner tub;

after the stopping the supplying of the water into the inner tub, spraying the water from the outer tub into the inner tub through the circulation nozzle by driving the pump and obtaining a change of water level within the outer tub as the water is sprayed through the circulation nozzle;

adjusting the operation setting based on the preliminary water supply time obtained and the change of water level obtained; and performing a washing operation based on the adjusted operation setting.

2. A method for controlling a washing machine including an outer tub, an inner tub to receive laundry, the inner tub provided in the outer tub and being rotatable about a substantially vertical axis, a pulsator rotatably provided in the inner tub, and a pump to pump water from the outer tub to a circulation nozzle that sprays the water into the inner tub, the method comprising:

sensing an amount of laundry in the inner tub;

configuring an operation setting based on the amount of the laundry sensed;

supplying water into the inner tub and obtaining a preliminary water supply time taken for a water level within the outer tub to reach a predetermined preliminary water supply level;

spraying the water discharged from the outer tub into the inner tub through the circulation nozzle by driving the pump and obtaining a change of water level within the outer tub while the water is sprayed through the circulation nozzle;

selecting a first preliminary water supply time range from preliminary water supply time ranges preset in accordance with materials of laundry classified based on moisture content ratios, the preliminary water supply time falling within the first preliminary water supply time range;

determining a material of laundry corresponding to the first preliminary water supply time range to be a material of laundry put into the inner tub when the preliminary water supply time obtained is greater than an upper limit of a second preliminary water supply time range one level lower than the selected first preliminary water supply time range by a predetermined reference value or more;

determining the material of the laundry further based on the water level change calculated when the preliminary water supply time calculated is greater than the upper limit of the second preliminary water supply time range by less than the reference value;

adjusting the operation setting based on the material of the laundry determined; and performing a washing operation in accordance with the adjusted operation setting.

3. The method of claim 2, wherein:

configuring the operation setting includes setting a main water supply level, and adjusting the operation setting further includes adjusting the main water supply level based on the determined material of the laundry.

4. The method of claim 3, wherein adjusting the operation setting further includes:

increasing the main water supply level when the material of the laundry has a moisture content ratio higher than a reference moisture content ratio; and decreasing the main water supply level when the material of the laundry has a moisture content ratio equal to or lower than the reference moisture content ratio.

5. The method of claim 2, wherein:

configuring the operation setting includes setting a water discharge time, and adjusting the operation setting further includes adjusting the water discharge time based on the determined material of the laundry.

6. The method of claim 2, wherein adjusting the operation setting further includes:

increasing the water discharge time when the material of the laundry has a moisture content ratio higher than a reference moisture content ratio; and decreasing the water discharge time when the material of the laundry has a moisture content ratio equal to or lower than the reference moisture content ratio.

7. A method for controlling a washing machine including an outer tub, an inner tub to receive laundry, the inner tub provided in the outer tub and being rotatable about a substantially vertical axis, a pulsator rotatably provided in the inner tub, and a pump to pump water from the outer tub to a circulation nozzle that sprays the water into the inner tub, the method comprising:

sensing an amount of laundry in the inner tub;

configuring a setting of a washing operation based on the amount of the laundry sensed;

supplying water to the inner tub and obtaining a preliminary water supply time taken for a water level within the outer tub to reach a predetermined preliminary water supply level;

spraying the water from the outer tub into the inner tub through the circulation nozzle by driving the pump and obtaining a change of water level within the outer tub as the water is sprayed through the circulation nozzle;

selecting a first preliminary water supply time range from preliminary water supply time ranges preset according to materials of laundry classified based on moisture content ratios, the preliminary water supply time being within the first preliminary water supply time range;

determining a material of laundry corresponding to the first preliminary water supply time range to be a material of laundry put into the inner tub when the preliminary water supply time is greater than an upper limit of a second preliminary water supply time range one level lower than the selected first preliminary water supply time range by a predetermined reference value or more;

determining the material of the laundry further based on the change of water level when the preliminary water supply time is greater than the upper limit of the second preliminary water supply time range by less than the reference value;

adjusting the setting of the washing operation based on the material of the laundry; and performing a washing operation in accordance with the adjusted setting.

8. The method of claim 7, wherein:

the setting of the washing operation includes an main water supply level, and adjusting the setting of the washing operation further includes adjusting the main water supply level based on the material of the laundry determined.

9. The method of claim 8, wherein adjusting the setting of the washing operation further includes:

increasing the main water supply level when the material of the laundry has a moisture content ratio higher than a reference moisture content ratio; and decreasing the main water supply level when the material of the laundry has a moisture content ratio equal to or lower than the reference moisture content ratio.

10. The method of claim 7, wherein:

the setting of the washing operation includes a water discharge time, and adjusting the setting of the washing operation further includes adjusting the water discharge time based on the material of the laundry determined.

11. The method of claim 10, wherein adjusting the setting of the washing operation further includes:

increasing the water discharge time when the material of the laundry has a moisture content ratio higher than a reference moisture content ratio; and decreasing the water discharge time when the material of the laundry has a moisture content ratio equal to or lower than the reference moisture content ratio.

* * * * *